US007434756B2

(12) United States Patent
Sotsky

(10) Patent No.: US 7,434,756 B2
(45) Date of Patent: Oct. 14, 2008

(54) ROTOR AND COUNTER KNIFE FOR A ROTARY GRINDER

(75) Inventor: George R. Sotsky, Louisville, KY (US)

(73) Assignee: Republic Machines, Inc., Louisville, KY (US)

( * ) Notice: Subject to any disclaimer, the term of this patent is extended or adjusted under 35 U.S.C. 154(b) by 60 days.

(21) Appl. No.: 10/261,024

(22) Filed: Sep. 30, 2002

(65) Prior Publication Data

US 2003/0061926 A1 Apr. 3, 2003

Related U.S. Application Data

(60) Provisional application No. 60/325,621, filed on Sep. 28, 2001.

(51) Int. Cl.

| | |
|---|---|
| ***B02C 1/10*** | (2006.01) |
| ***B02C 7/12*** | (2006.01) |
| ***B02C 13/28*** | (2006.01) |
| ***B02C 15/16*** | (2006.01) |
| ***B02C 17/20*** | (2006.01) |
| ***B02C 23/00*** | (2006.01) |

(52) U.S. Cl. ..... 241/283; 241/242; 241/243

(58) Field of Classification Search ..... 241/294, 241/293, 243, 242; 83/698.41, 839, 855; 407/40, 61, 62, 113

See application file for complete search history.

(56) References Cited

U.S. PATENT DOCUMENTS

| | | | | |
|---|---|---|---|---|
| 286,535 | A | | 10/1883 | Everding |
| 1,301,964 | A | | 4/1919 | Overbury |
| 1,567,920 | A | | 12/1925 | Cumfer |
| 1,874,902 | A | | 8/1932 | Clyne |
| 2,655,213 | A | | 10/1953 | Anderson |
| 2,812,815 | A | | 11/1957 | Quinsey, et al. |
| 3,143,016 | A | | 8/1964 | Obenshain |
| 3,186,277 | A | | 6/1965 | Brunner |
| 3,426,674 | A | | 2/1969 | Testolin |
| 3,760,673 | A | | 9/1973 | Peterson, Jr. |
| 4,590,978 | A | | 5/1986 | Kintz et al. |
| 5,150,844 | A | | 9/1992 | McKie |
| 5,273,218 | A | | 12/1993 | Burns |
| 5,320,292 | A | * | 6/1994 | Smith ..... 241/191 |
| 5,320,293 | A | | 6/1994 | Laly et al. |
| 5,402,948 | A | | 4/1995 | Kaczmarek |
| 5,474,239 | A | | 12/1995 | Williams, Jr. et al. |
| 5,544,826 | A | * | 8/1996 | Klingler et al. ..... 241/242 |
| 5,695,134 | A | | 12/1997 | Williams |
| 5,711,492 | A | | 1/1998 | Cheladze |
| 5,871,119 | A | * | 2/1999 | Blackinton, Jr. ..... 222/1 |
| 5,947,395 | A | | 9/1999 | Peterson et al. |
| 5,971,305 | A | * | 10/1999 | Davenport ..... 241/197 |

(Continued)

*Primary Examiner*—Bena Miller
(74) *Attorney, Agent, or Firm*—James Cole; Middleton Reutlinger

(57) ABSTRACT

The present invention relates to a single shaft rotary grinder with an improved cutter and combination "comb" rotor and counter knife configuration for reducing film, fibrous material and other material which has a tendency to wrap around the rotor, rubber, solid plastics and wood. Reducing this type of material, such as plastic film, into small pieces has been problematic. This invention provides one or more comb shaped counter knives and a rotor having a plurality of geometrically shaped cutters mounted in a plurality of partial or full rows longitudinally along the rotor. The comb shaped counter knives and the rows of cutters work in cooperation to reduce film and other material into small pieces.

8 Claims, 18 Drawing Sheets

U.S. PATENT DOCUMENTS 5,988,544 A 11/1999 Williams, Jr.
6,305,623 B1 10/2001 Sotsky et al.
6,308,905 B1 10/2001 Balvanz et al.
6,394,378 B1 * 5/2002 Ragnarsson ..... 241/294
6,422,495 B1 * 7/2002 De Boef et al. ..... 241/197

* cited by examiner

ROTOR AND COUNTER KNIFE FOR A ROTARY GRINDER

CROSS REFERENCE TO RELATED APPLICATION

This application claims the benefit of U.S. Provisional Application No. 60/325,621, filed Sep. 28, 2001.

BACKGROUND OF THE INVENTION (a) Field of the Invention

The present invention relates to a single shaft rotary grinder with an improved cutter and combination "comb" rotor and counter knife configuration for reducing film, fibrous material and other material which has a tendency to wrap around the rotor, rubber, solid plastics and wood. Reducing this type of material, such as plastic film, into small pieces has been problematic. This invention provides one or more comb shaped counter knives and a rotor having a plurality of geometrically shaped cutters mounted in a plurality of partial or full rows longitudinally along the rotor. The comb shaped counter knives and the rows of cutters work in cooperation to reduce film and other material into small pieces.

(b) Description of the Prior Art

U.S. Pat. No. 3,760,673, to Peterson, Jr. teaches an apparatus for dicing plastic sheet material, rather than film or fibrous material, in which a horizontal rotor has teeth on the periphery thereof which are in cutting relationship to the serrations on a stationary bed knife. The bed knife is tilted at an angle to the axis of the rotor. The rotor contains a series of straight knives which each contain a plurality of teeth which cooperate with the serrations on the stationary bed knife. The tilt of the bed knife causes the teeth of each rotor knife to first come into cutting engagement with the bed knife teeth at the left end of the bed knife and then to be brought into cutting engagement last with the teeth at the right end of the bed knife.

U.S. Pat. No. 3,186,277 to Brunner teaches an apparatus for cutting a strip of sheet material, rather than film or fibrous material, into separate particles which has a stationary bed knife having rectangular teeth and individual rectangular recesses between the teeth, a knife supporting rotor arranged axially parallel to the bed knife, and profiled knives on the rotor arranged in axially and angularly spaced relation with each cooperating with one of said recesses between the teeth of the stationary bed knife. The rotor also contains straight knives arranged in axially and angularly spaced relation which cooperate with the top of at least two teeth of the stationary bed knife.

U.S. Pat. No. 2,812,815 to Quinsey et al. teaches a method and apparatus for dicing a strip of sheet material, rather than film or fibrous material, into uniform sized and shaped pellets, both employing a bed knife with rectangular shaped teeth and a non-cylindrical rotor containing sets of fly knives, where each set of fly knives is comprised of a toothed knife with teeth complementary to the bed knife teeth and a cut off knife having a continuous linear cutting edge which cooperates with the front edge of the bed knife.

U.S. Pat. No. 1,874,902 to Clyne teaches a method of cutting sheets and a sheet cutting machine employing a cutter bar having substantially rectangular shaped teeth and rectangular shaped notches therebetween, all with cutting edges and a cutter with a plurality of rows of teeth with notches therebetween which correspond to the notches and teeth of the cutter bar During engagement, the cutter teeth do not fully engage the length of the notches on the cutter bar. Between each engagement of the row of teeth on the cutter with the cutter bar, the sheet to be cut is fed forward less than the length of a tooth on the cutter bar, thereby allowing only that portion of the sheet which has been fed past the edge of the cutter bar teeth and notches to be engaged by a row of teeth on the cutter bar. The size of the particle cut from the sheet is therefore controlled by how the material is fed towards the rotor.

Reducing product such as film utilizing the single shaft rotary grinders present in the field today is problematic. Film for products such as plastic bags, plastic wrapping, garbage bags and sandwich bags and fibrous material such as rope and string have increasingly been manufactured with qualities of reduced thickness (less than 0.0254 mm (0.001 inches)) and increased durability, which cause the product to be more difficult to reduce. A common problem arises when the product wraps around the rotor with the cutter poking through the product, rather than being reduced into smaller pieces. An additional problem is created when, due to wrapping, the diameter of the product build-up is increased to the point that rubbing occurs, generating heat which may cause melting or other damage to the grinder. Another problem occurs because the combination of rotor and screen, with specific screen hole sizes, is inefficient in controlling reduction of the product to a maximum size, thus adding frictional heat to the process.

BRIEF SUMMARY OF THE INVENTION

The present invention relates to a single shaft rotary grinder with an improved cutter and combination "comb" rotor and counter knife configuration for reducing film, fibrous material and other material which has a tendency to wrap around the rotor, rubber, solid plastics and wood. Reducing this type of material, such as thin plastic film, into small pieces has been problematic. In a first embodiment, this invention provides one or more comb shaped counter knives and a rotor having a plurality of geometrically shaped cutters mounted in a plurality of partial or full rows longitudinally along the rotor. The comb shaped counter knives and the rows of cutters work in cooperation to reduce film and other material into small pieces.

Rotary grinders are used to reduce material to a desired particle size for recycling and other purposes. The material to be shredded is placed in a hopper and a ram is used to drive the material toward one or more counter knives aligned in a row and a parallel rotor, the rotor having a plurality of cutters removably mounted thereon. When in use, the ram travels from its open position near the front end of the rotary grinder across the hopper floor towards the rotor, pushing material to be ground towards the rotor. As the rotor revolves about its shaft, the cutters on the rotor engage the material in the hopper, cutting or tearing pieces from the material and drawing the pieces downward towards the counter knives. The counter knives have teeth with cutting edges and interstices between the teeth. Counter knives commonly have "V" shaped teeth and "V" shaped interstices. The interstices are sized to receive the cutters, which commonly protrude from the rotor in a "V" shape, and the sizing of the interstices allows the cutters to pass in close proximity to the cutting edges of the teeth.

The material is further reduced as it is drawn between the cutters and the teeth of the counter knives. An optional screen placed after the rotor controls how finely the material will be ground. The screen has a plurality of openings of a specific size selected by the user. One grinder may have a plurality of rotor screens, each with a different size opening therethrough. A rotor screen with desired size openings is selected and positioned after the rotor. When the material is reduced to the appropriate size, it will pass through an opening in the screen into a conveying device. Reduced material which is too large to pass through the rotor screen openings and requires further reduction will be drawn by the action of the cutters back into the hopper area to be further reduced or will be further reduced by the action of the cutters as they abrade against material trapped between the screen and the cutters. After material passes through the screen and out of the rotary grinder, it may be passed through a granulator for further reduction, if required.

The comb shaped counter knives and rotor combination of the present invention has several advantages over other known counter knife and rotor combinations. First, the rectangularly shaped counter knife teeth and interstices form a comb shape along the length of the counter knife, and rectangularly shaped cutters aligned longitudinally form a comb shape row along the rotor, the rotor having a plurality of rows of cutters placed in this comb configuration. The combing action of the cutter and counter knife configuration and the "scissor" cutting action between the cutting edges of the cutter and the cutting edges of the counter knife teeth diminish the likelihood that film will wrap around the rotor. Second, the close spacing between the cutters and counter knives, combined with all cutters being arranged in partial or full longitudinal rows, increases the likelihood that particle size will have a length which approximates the distance between cutter rows and a width and depth that approximates the longitudinal and radial distance between the adjacent cutters. Third, the rows or partial rows of cutters engaging this film simultaneously clamp and hold the product "stretched," so that the comb teeth can break the product, thus eliminating the requirement for extremely close tolerances between cutter and counter knife. Thus, product size may be controlled by the cutting action of the rotor rather than screen hole size.

In an alternate embodiment of the rotor, the rectangular cutters are arranged in at least pairs or partial rows randomly or staggered along the rotor body. As the rotor revolves, each cutter pair passes through a corresponding pair of interstices, thereby fully cooperating with one tooth and partially cooperating with two teeth of the counter knife. Cutting action is reduced from the first embodiment due to only partial engagement of two of the three teeth engaged. However, the cutter pair configuration randomly dispersed along the rotor body provides a more even feed of material to the screen and further minimizes the likelihood that the film will build up and pack together or clog the screen, as well as a more even torque requirement.

The preferred embodiment, which is a further alternate embodiment of the cutter, rotor and counter knife, generally hexagonally shaped cutters are arranged in a plurality of preferably partial rows along the rotor body. This embodiment provides one or more comb shaped counter knives which work in cooperation with the partial rows of cutters to reduce film into small pieces. The hexagonal shape of the cutters increases the cutting surfaces on the cutter and minimizes the amount of non-cutting surfaces on the counter knife and rotor while still maintaining the advantages of the combing action of the counter knife. The partial row of cutters configuration staggered along the rotor body provides a more even feed of material to the screen and reduces the amount of instantaneous torque required to power the rotor. In addition, the full cutting action of the cutter allows continuous cutting of solid plastic and rubber without encountering a non-cutting surface on the rotor. Another feature of this embodiment of the invention is that the cup shape of the cutters and the cutting action of the cutters on the face of a solid reduces the material before it reaches the counter knife. The cutter of this embodiment may also be arranged in pairs or full rows longitudinally along the rotor.

It is an object of the invention to create a combination "comb" rotor and counter knife configuration which reduces any material that tends to wrap around the rotor or which creates undesirable friction during the reducing process. Another object of the invention is to reduce or eliminate heat generated by friction during the cutting process, which will eliminate or reduce the need to utilize expensive methods of cooling the rotor.

BRIEF DESCRIPTION OF THE DRAWINGS

A better understanding of the invention will be had upon reference to the following description in conjunction with the accompanying drawings wherein.

DETAILED DESCRIPTION OF THE PREFERRED EMBODIMENT

Figure 1:
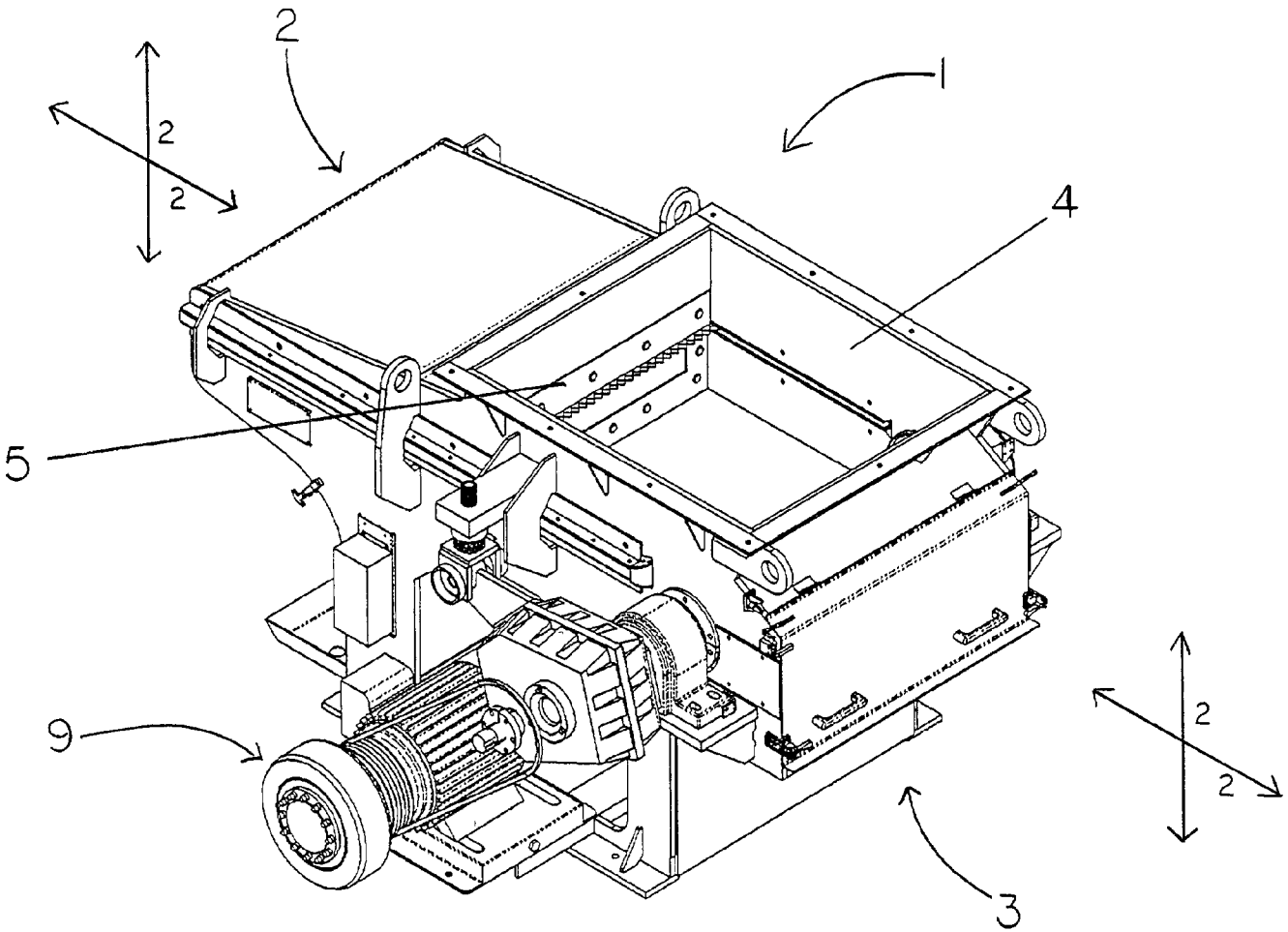
FIG. 1 is a perspective view from the upper left side of a prior art rotary grinder, showing the outer frame of the grinder, a hopper, a ram in retracted position, and a motor which provides power to the rotor.

With reference to the Figures, FIG. 1 shows a prior art rotary grinder 1 having a front end 2, a back end 3, a hopper 4, a ram 5 in retracted position, a rotor 6 (not shown), at least one counter knife 7 (not shown), a plurality of cutters 8 and a motor 9 which provides power to the rotor 6.

Figure 2:
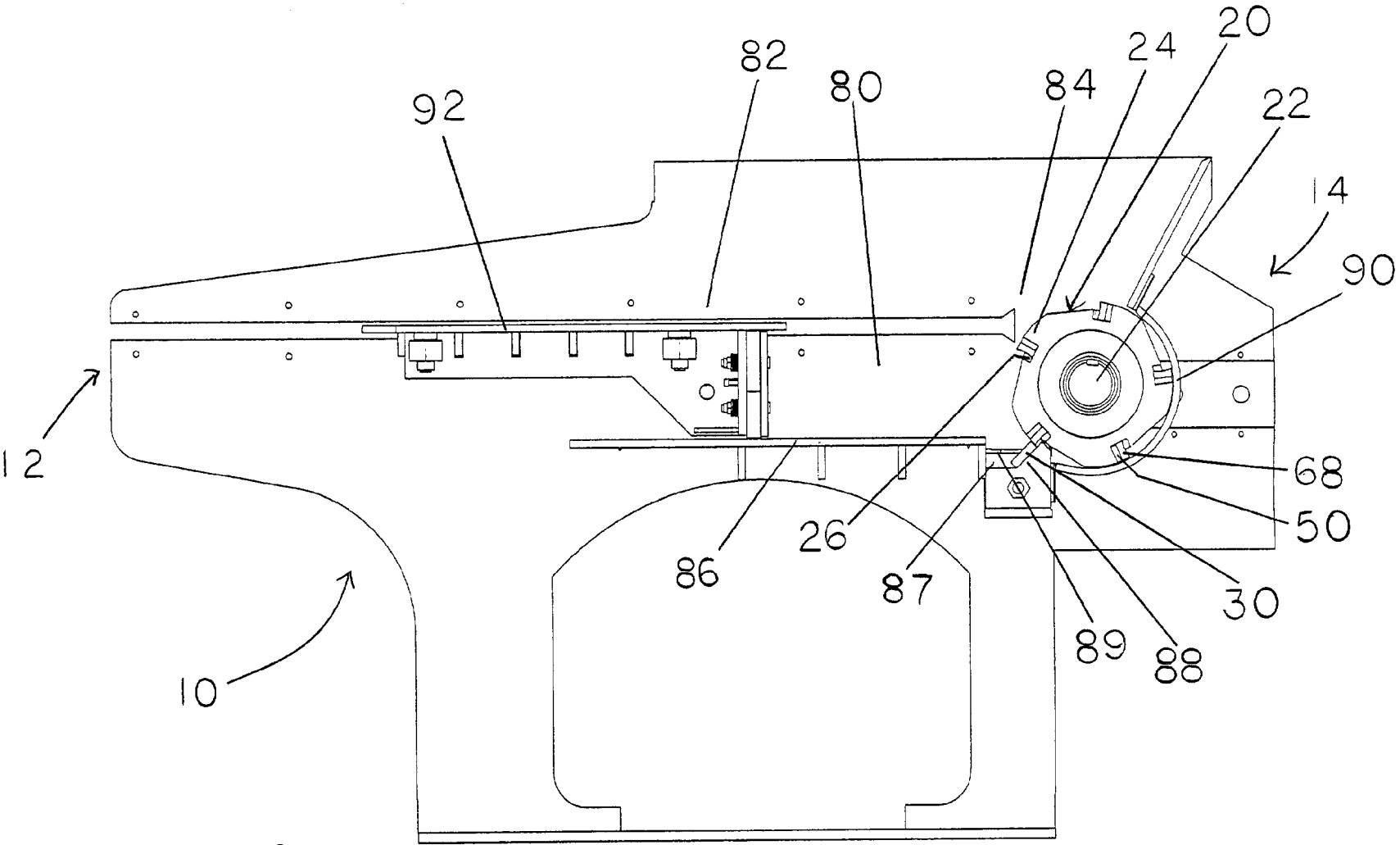
FIG. 2 is a cross-sectional view of a rotary grinder taken along the line 2-2 of FIG. 1, which has added thereto an embodiment of the rotor and counter knife combination of the present invention, the ram in a partially retracted position, a hopper, and a rotor screen positioned after the rotor.

FIG. 2 shows a rotary grinder 10 similar to the rotary grinder 1 of FIG. 1, but containing an embodiment of the rotor 20 and counter knife 30 combination in the comb configuration of the present invention. The rotary grinder 10 of FIG. 2 has a front end 12; a back end 14; a hopper 80 having a hopper front end 82, a hopper back end 84, a hopper floor 86, and a trough 87 with an angled trough wall 88 in the hopper floor 86 at the hopper back end 84; a ram 92 shown in a partially retracted position towards the hopper front end 82; a rotor 20 mounted on a shaft 22 (see also, FIG. 5) at the hopper back end 84; at least one counter knife 30 mounted on the angled trough wall 88; a filler plate 89 over the trough 87; and an optional rotor screen 90 positioned after the rotor 20. FIG. 2 also depicts the rotor 20 having tool attachments 24 integral to the rotor 20, a slot 26 in the rotor 20 in front of each tool attachment 24; cutters 50 partially received in slots 26 and mounted to corresponding tool attachments 24; a cushioning plate 68 mounted between each cutter 50 and the corresponding tool attachment 24; and a groove 72 between adjacent tool attachments 24.

As shown in FIG. 2, a counter knife 30 is mounted before the rotor 20 at the hopper back end 84 on the angled trough wall 88 (see FIGS. 2, 5, 6, and 8). A filler plate 89 may be placed over the trough 87 to prevent material to be reduced from accumulating in the trough 87. A rotor screen 90, whose use is optional, is shown positioned after and in close proximity to the rotor 20 to prevent or minimize the likelihood that large amounts of fully or partially reduced material will build up in the screen 90 and pack together or clog the screen openings.

Figure 3:
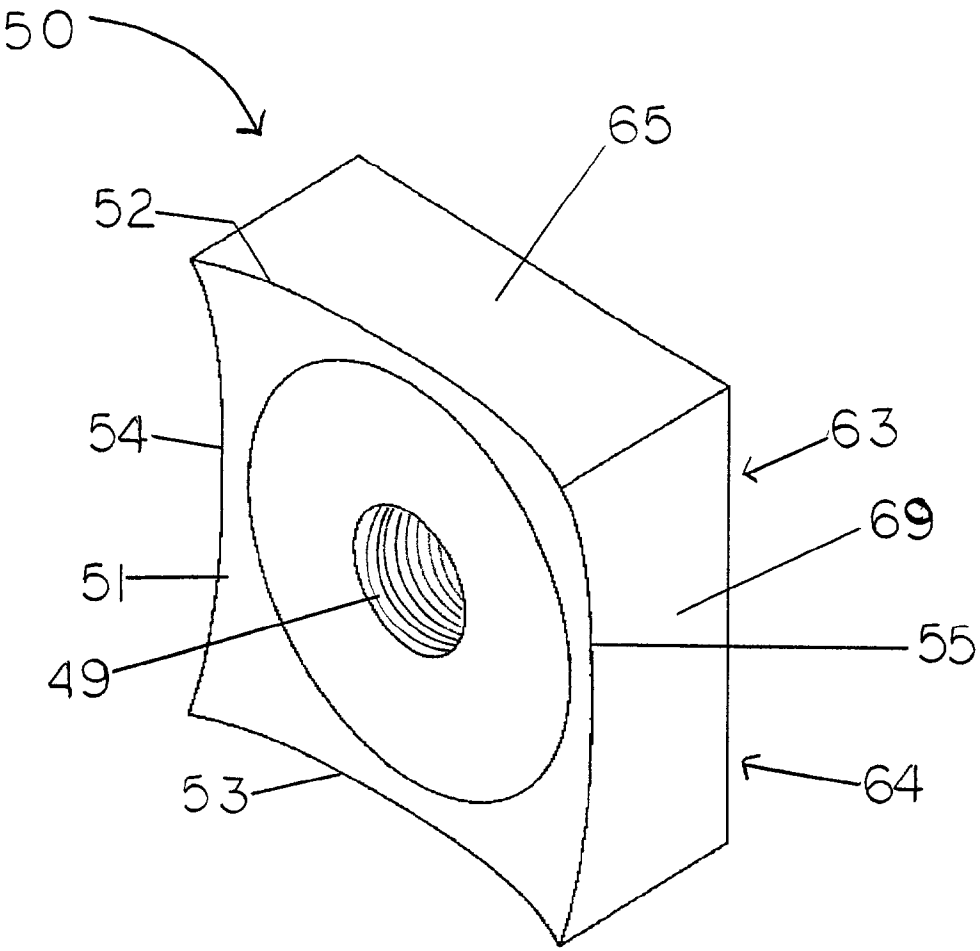
FIG. 3 is a perspective view of the cutter shown in FIG. 2.

As shown in FIG. 3, the cutter 50 of the present embodiment is rectangular and has a slightly concave front face 51 having a top edge 52, a bottom edge 53, a left edge 55 and a right edge 54; a back face 62 (not shown) having a generally flat surface; a threaded bore 49 for accepting a screw for mounting onto a tool attachment 24 extending from the back face 62 to the front face 51; a top portion 63; a bottom portion 64; and a top side 65, a bottom side 66 (not shown), a right side 67 (not shown) and a left side 69. The four edges of the front face 51, namely top edge 52, bottom edge 53, right edge 54 and left edge 55, are cutting edges. The top portion 63 and bottom portion 64 of the cutter 50 are generally mirror images, allowing the cutter 50 to be indexable such that, when the cutter is rotated 180 degrees, fresh cutting edges are revealed. While the present invention discloses two index positions, it is contemplated that the cutter 50 be indexable to a plurality of positions. Each cutter 50 is preferably made of hardened tool steel suitable to the application, but may be made of any suitable material.

Figure 6:
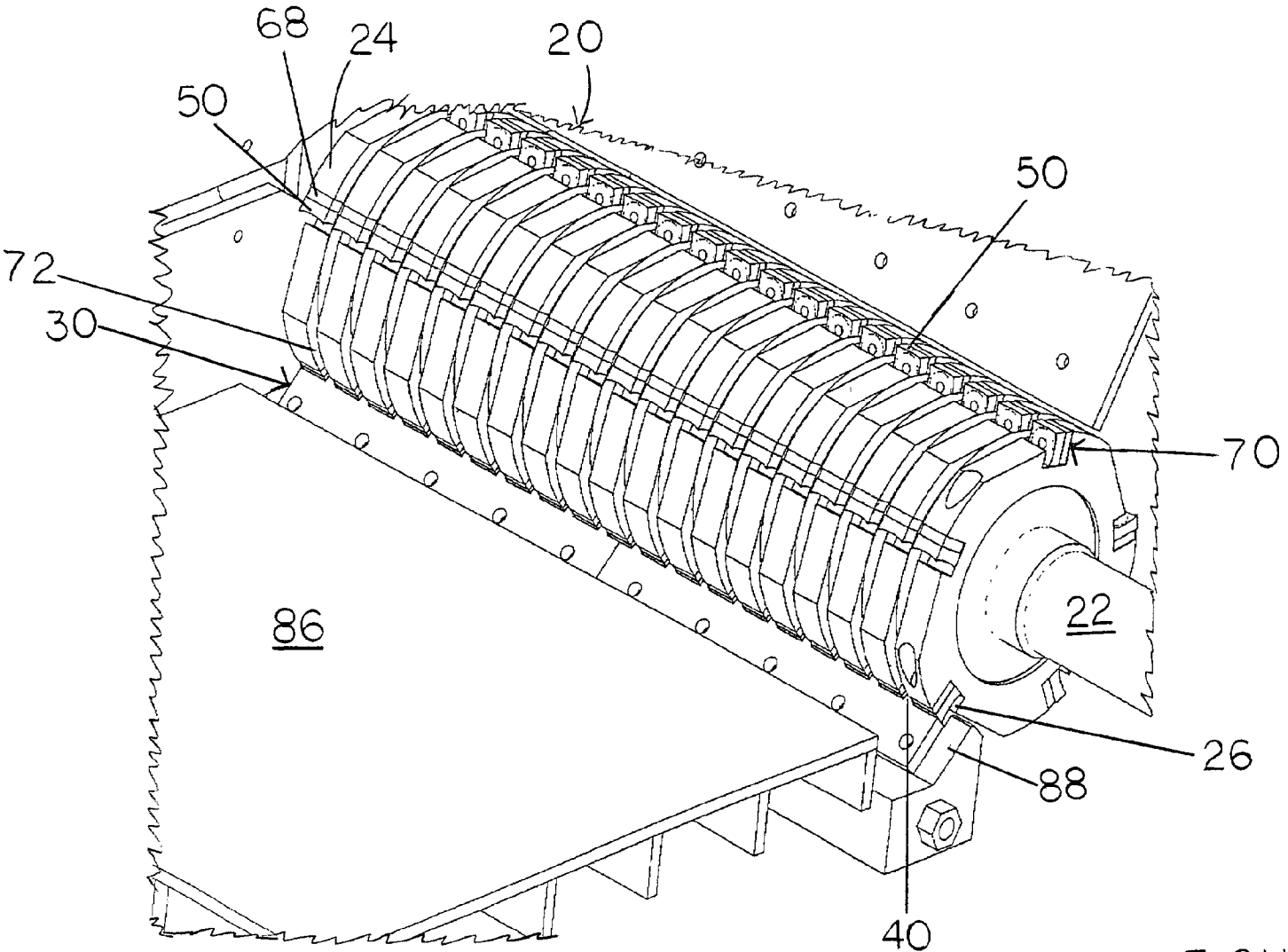
FIG. 6 is a partial perspective view of the rotary grinder of FIG. 2, showing the cutters mounted on the rotor in rows and the cutters passing through the interstices between the teeth of the counter knives.
Figure 8:
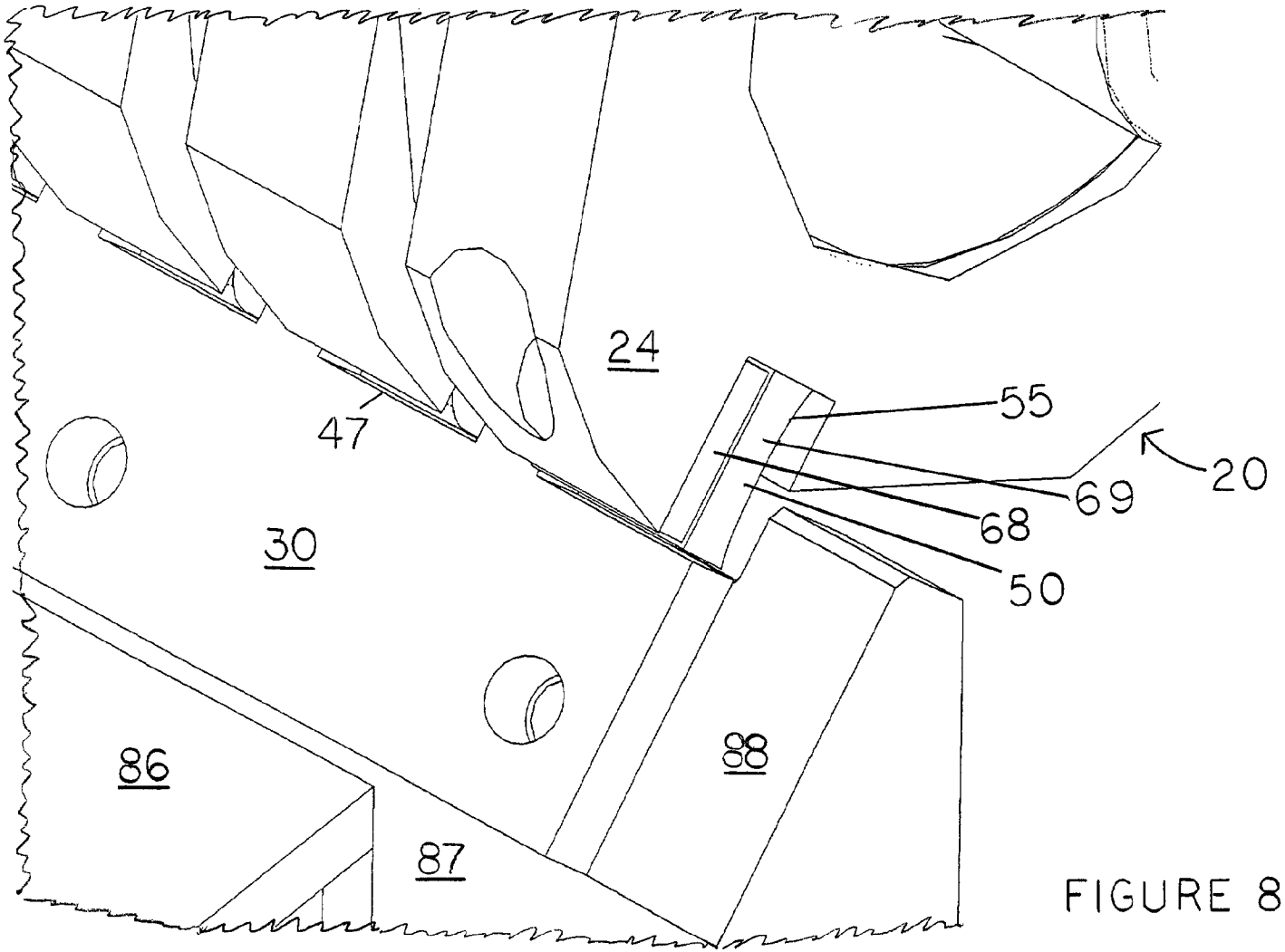
FIG. 8 is an enlarged partial perspective view of the rotor and counter knives of FIG. 2 working in cooperation, showing the tool holders, cushioning plate, and cutters passing through the interstices of the counter knives.

As shown in FIGS. 2, 6 and 8, a cutter 50 is removably mounted to each tool attachment 24. The tool attachments 24 are preferably machined into and integral with the rotor 20; however, the tool attachments 24 may instead be welded or otherwise suitably attached or mounted to the rotor 20. The rotor has a plurality of grooves 72 thereon between adjacent tool attachments 24 and which are between adjacent cutters 50 after they are mounted on the tool attachments 24. The slot 26 in the rotor 20 in front of each tool attachment 24 partially receives a cutter 50 when it is removably mounted to that tool attachment 24. For instance, the bottom portion 64 of a cutter 50 can be inserted into a slot 26 with the back face 62 towards the tool attachment 24 and the cutter bottom side 66 resting against the bottom of the slot 26. In this configuration, the top portion 63 of the cutter 50 protrudes out of the slot 26 and functions as the working portion of the cutter 50. When the cutting edges of the cutter top portion 63, namely top edge 52, the upper portion of left edge 55 and the upper portion of right edge 54, are worn, the cutter 50 may be removed, rotated 180 degrees and remounted. In this configuration, the bottom portion 64 of the cutter 50 protrudes out of the slot 26 and functions as the working portion of the cutter 50. When the cutting edges of the cutter bottom portion 64, namely bottom edge 53, the lower portion of left edge 55 and the lower portion of right edge 54, are worn, the cutter 50 would then be removed and retooled or replaced with a new cutter 50.

An optional cushioning plate 68 may be mounted between each cutter back face 62 and the corresponding tool attachment 24 in order to absorb shock and minimize or prevent damage to the tool attachment 24. Each cushioning plate 68 is preferably made of a medium hard steel but may be made of any suitable material.

Figure 4:
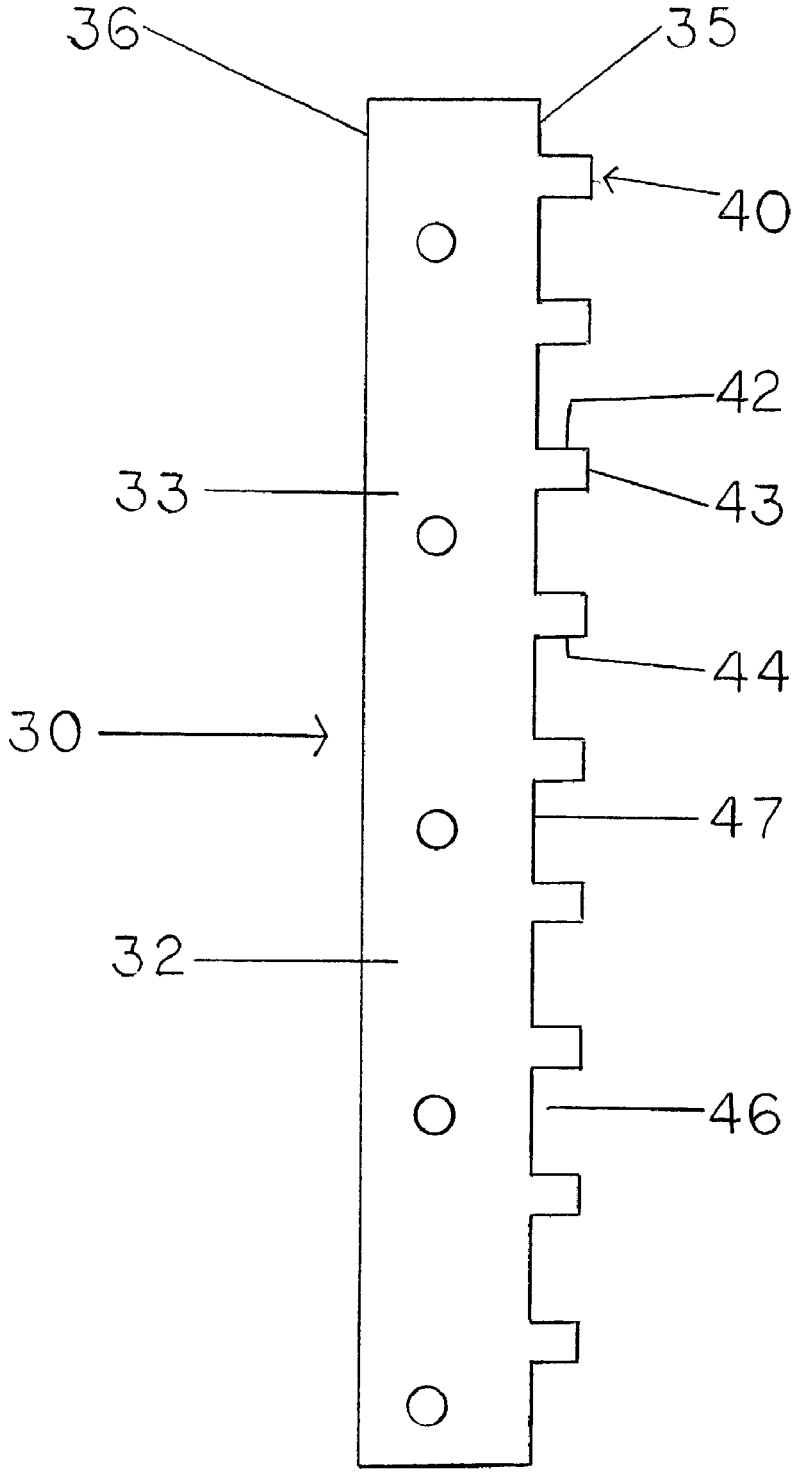
FIG. 4 is a top view of the counter knife shown in FIG. 2, having a body, rectangularly shaped teeth, and rectangularly shaped interstices.

As best shown in FIG. 4, the counter knife 30 of the instant embodiment has a generally flat body 32, a top 33, a bottom 34 (not shown), a front 35, a back 36; a plurality of teeth 40 extending laterally in the same plane as the body 32 from the front 35 of the body 32. Each tooth 40 forms three sides of a rectangle, having a first tooth edge 42, a second tooth edge 43 and a third tooth edge 44. Each pair of adjacent teeth 40 defines an interstice 46 which is open on one side and whose three other sides form three sides of a rectangle defined by a third tooth edge 44, an interstice edge 47, and a first tooth edge 42. These edges 42, 44, 47 which form the interstice 46 are each a cutting edge. When the rotor 20 and counter knife 30 are properly installed in the rotary grinder 10 and the rotor is rotating, the teeth 40 are designed to protrude into the groove 72 between adjacent cutters 50 as each of the adjacent cutters 50 are passing through the corresponding interstices 46 on the counter knife 30. The combination of teeth 40 projecting from the counter knife body 32 with interstices 46 therebetween thereby form a comb configuration.

The second tooth edge 43 is preferably 16.002 mm (0.630 inches) in width but may be any suitable width as required by the application and the spacing between the cutters 50. The interstices 46 between the teeth 40 are each preferably 41.173 mm (1.621 inches) in width but may be any suitable width as required by the width of the cutters 50 and the application.

The counter knife 30 is indexable, being symmetrical on its top 33 and bottom 34 sides, such that the counter knife 30 can be turned over to expose fresh cutting edges and remounted with its bottom 34 facing upward when the upper portions of the cutting edges 42, 44, 47 become dull. This allows the cutting edges 42, 44, 47 at the top 33 and bottom 34 sides of the counter knife 30 to be used before the edges 42, 44, 47 are resharpened. Each counter knife 30 is preferably made of hardened tool steel suitable to the application, but may be made of any suitable material.

Figure 5:
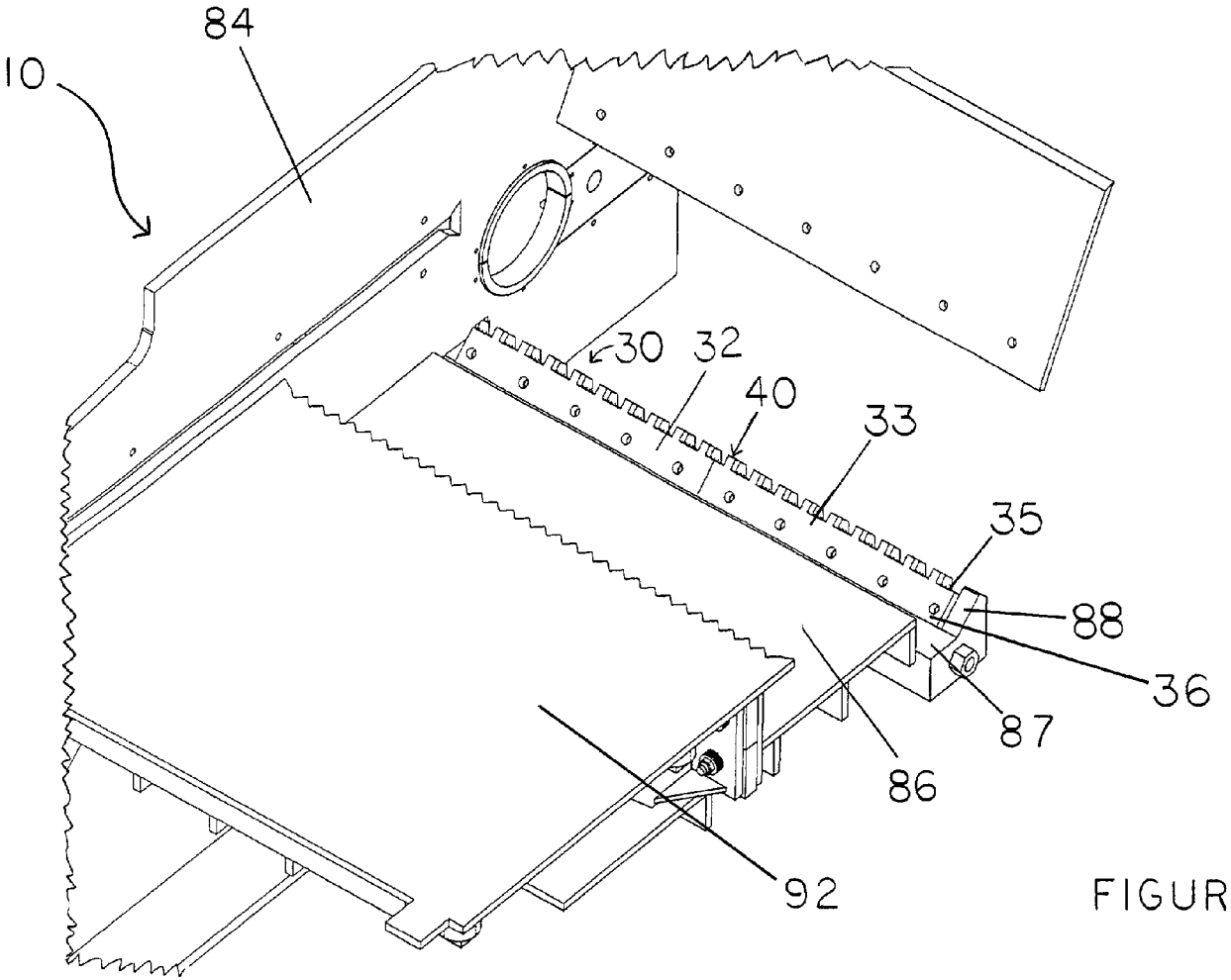
FIG. 5 is a partial perspective view from the upper left side of the rotary grinder of FIG. 2, with certain structures and the rotor removed for clarity, showing two counter knives installed in the grinder at an upward angle.

As shown in FIGS. 5 and 6, a plurality of counter knives 30 may be installed adjacent each other in the rotary grinder 10. The number of counter knives 30 employed, the length of the counter knife 30, the number of fill and partial teeth 40 on the counter knife 30, the length and width of the teeth 40 and the width of the interstices 46 are dependent upon the length and size of the rotor 20, the number of cutters 50 employed longitudinally along the rotor 20, the size of the cutters 50 and the positioning of the cutters 50 in relation to adjacent cutters 50. FIGS. 4 and 5 clearly show two counter knives 30 installed on the angled trough wall 88 in the floor 86 at the hopper back end 84. The counter knives 30 are installed with their bottom 34 portions towards the floor of the trough 87 and with the front 35 portions of their bodies 32 and teeth 40 extending upward at an angle towards the rotor 20.

As shown in FIG. 6, the tool attachments 24 on the rotor 20 may be arranged longitudinally in rows, and the cutters 50 are mounted to the tool attachments 24 so that the cutters 50 form a comb configuration with cutter rows 70. Optionally, a cushioning plate 68 may be mounted between the tool attachment 24 and the cutter 50 as shown in FIGS. 2,6 and 8.

As best shown in FIG. 5, the rotor 20 of the instant embodiment preferably has five rows 70 of cutters 50 arranged longitudinally along the rotor 20 body. However, the rotor 20 may contain a greater or lesser number of cutter rows 70, and correspondingly a greater or lesser number of total cutters 50 on the rotor 20. Cutters 50 immediately adjacent each other in a row 70 are preferably spaced 16.51 mm (0.650 inches) apart, but may be spaced apart any suitable distance as required by the application. Additionally, the number of cutters 50 per row 70 will be influenced by the length of the rotor 20. For instance, a 106.68 cm (42 inch) rotor 20 may have five rows 70 of cutters 50, with nineteen cutters 50 in each row 70, for a total of ninety-five cutters 50 on the rotor 20. The number of cutters 50 on each rotor 20 will influence the amount of horsepower required to power the rotor 20. An increase in the number of cutters 50 present on the rotor 20 will increase the amount of horsepower required, and a decrease in the number of cutters 50 will decrease the amount of horsepower required. The total number of cutters 50 on the rotor 20 affects the total horsepower required. The total number of cutters 50 in a row 70 effects the instantaneous or peak torque required. Particle size produced by a single pass of a cutters 50 through an interstice 46 is regulated by the size of the cutter 50 and not the number of cutters 50 on the rotor 20 or in the row 70. As best shown in FIGS. 5, 6 and 8, the counter knife 30 mounting is angled in order for the teeth 40 and interstices 46 to be in the same or slightly different plane as the cutters 50 when the cutters 50 enter the interstices 46.

Figure 7:
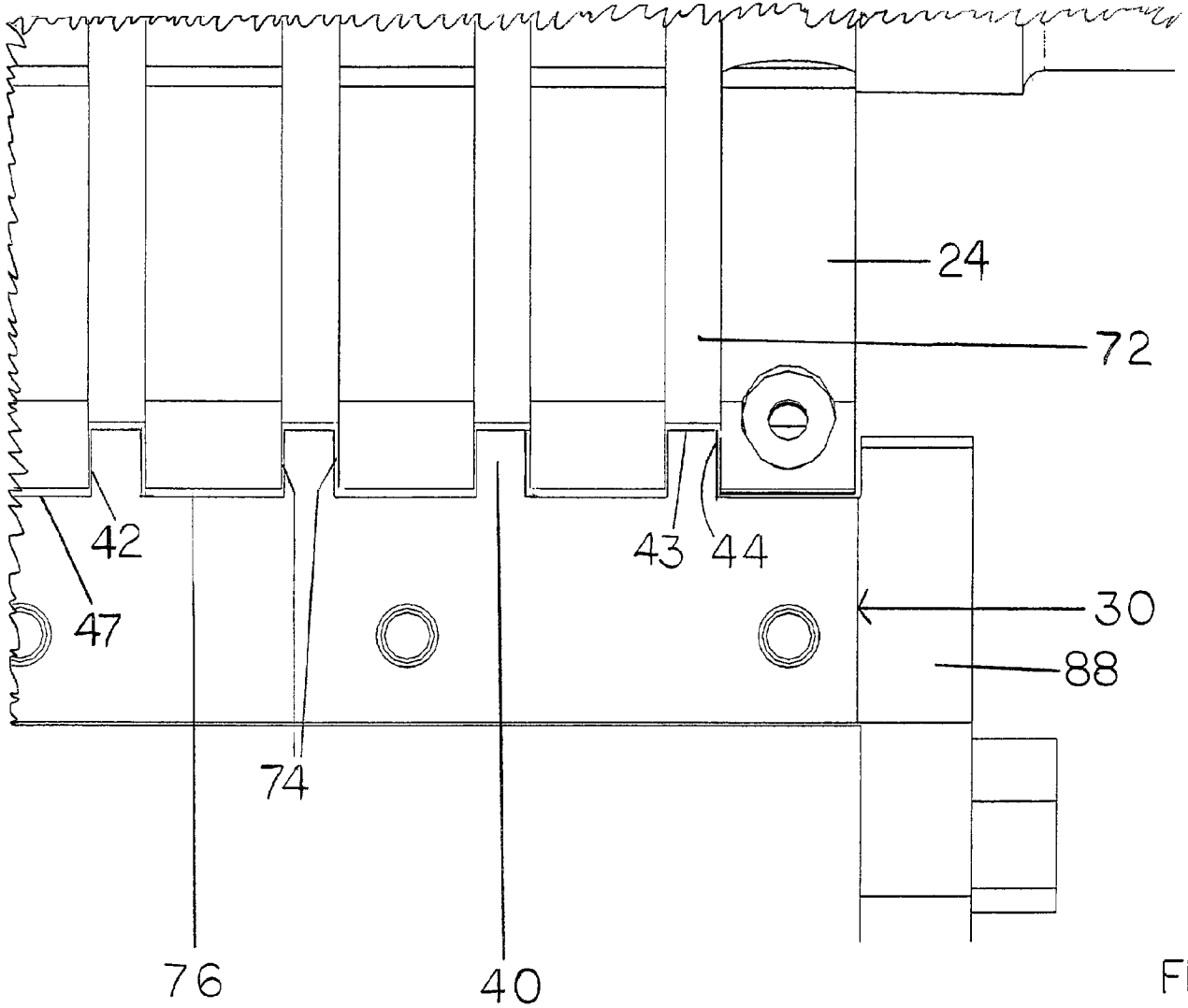
FIG. 7 is an enlarged partial top view of the rotor and counter knives of FIG. 2 working in cooperation, showing the tool holders to which the cutters are mounted passing through the interstices of the counter knives.

As shown in FIGS. 6-8, when the rotor 20 revolves on its shaft 22, each cutter 50 passes at a small distance from the counter knife 30 through a corresponding interstice 46 located in the same vertical plane as the cutter 50. Additionally, each tooth 40 located between two adjacent interstices 46 protrudes into the groove 72 between the two adjacent cutters 50 located in the same vertical plane as each of the two adjacent cutters 50 is passing through the corresponding one of the two adjacent interstices 46, the tooth 40 protruding to within a small distance from the rotor 20, which effectively "combs" the rotor 20. As a cutter 50 passes through an interstice 46, it is preferred that there is a first spacing 74 of 0.254 mm (0.010 inches), with a manufacturing tolerance of 0.127 mm (0.005 inches), between the third tooth edge 44 and the right edge 54 and between the first tooth edge 42 and the left edge 55; and a second spacing 76 of 0.127 mm (0.005 inches), with a manufacturing tolerance of 0.050 mm (0.002 inches), between the of cutter top edge 52 and the interstice edge 47, although the first spacing 74 and second spacing 76 may be larger or smaller if required by the application. However, due to the temperature variation caused by the heat produced as the rotor 20 rotates and the resulting expansion of the rotor 20 in length, it would not be practical to reduce the first spacing 74 or second spacing 76 without employing a means to cool the rotor 20. The first spacing 74 and second spacing 76 are also present when the cutter 50 is indexed 180 degrees to its second index position.

When the ram 92 pushes the film to be reduced into the revolving rotor 20, each longitudinal cutter row 70 engages a portion of the film and drags it towards the counter knives 30. As the cutters 50 move downward towards the counter knives 30, film is stretched tight over adjacent cutters 50 along the cutter row 70. As the cutter row 70 passes through the interstices 46, the film is caught between the cutters 50 and the cutting edges 42, 44, 47 of the counter knife 30. The corresponding tooth 40 projecting into the groove 72 between two adjacent cutters 50 over which film is stretched will puncture and tear the film as the cutters 50 pass through the interstices 46. When the film wraps and/or becomes stretched between cutters 50, the teeth 40 of the counter knife 30 "comb" the groove 72 between the cutters 50 and strip the film from its wrapped or stretched position. Additionally, when there is a sufficiently close spacing between each cutter 50 and the counter knife 30 (see FIGS. 7 and 8) and/or layers of film have built up sufficiently on the cutters 50 to fill the gap between the cutter 50 and the counter knife 30, further cutting action is provided by the scissor action between the two parallel sides 67, 69 and cutting edges 55, 54 of the cutter 50 and the corresponding cutting edges 42, 44 of adjacent teeth 40. The close spacing between the cutters 50 and counter knives 30, combined with all cutters 50 being arranged in partial 170 or full longitudinal rows 170, increases the likelihood that particle size will have a length which approximates the distance between cutter rows 70, 170 and a width and depth that approximates the longitudinal and radial distance between the adjacent cutters 50.

Figure 9:
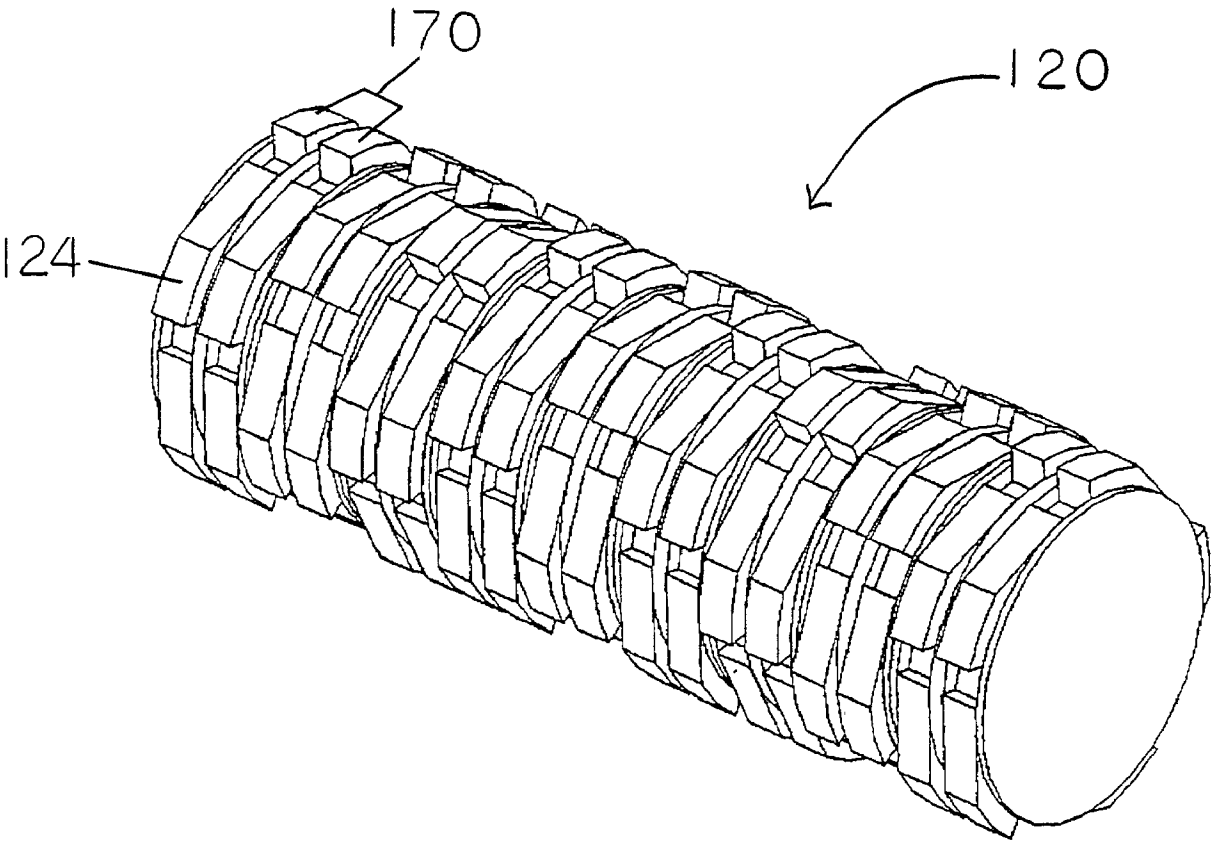
FIG. 9 is a perspective view of an alternate embodiment of the rotor of the present invention, the rotor having cutters mounted in pairs and having cutter pairs randomly distributed along and around the rotor.

FIG. 9 shows an alternate embodiment of the rotor 120 of the present invention where pairs consisting of two adjacent tool attachments 124 are arranged in a staggered or random pattern longitudinally along the rotor 120 body. The tool attachments 124 are preferably machined into and integral with the rotor 120; however, the tool attachments 124 may instead be welded or otherwise suitably attached or mounted to the rotor 120. This arrangement of tool attachments 124 in staggered or randomly placed pairs longitudinally along the rotor 120 with cutters 50 mounted thereon results in "cutter pairs" 170 such that two cutters 50 work in cooperation to cut the material to be reduced.

As in the first embodiment shown in FIGS. 2-8, a same cutter 50 is compatible with and may be used with the rotor 120 configuration of the present embodiment. The counter knife 30 of the first embodiment depicted in FIG. 4 is also compatible with and may be used with the rotor 120 configuration of the present embodiment. The spacing between the cutters 50 comprising the cutter pairs 170 are the same spacing as between the cutters 50 comprising the cutter rows 70, and the first spacing 74 and second spacing 76 between the counter knife 30 and the cutters 50 remain the same.

When the ram 92 pushes the film to be reduced into the revolving rotor 120, each cutter pair 170 engages a portion of the film and drags it towards the counter knives 30. As the cutter pair 170 rotates downward towards the counter knives 30, film is stretched tight over the cutter pair 170. As the cutter pair 170 passes through the corresponding interstices 46 on the counter knife 30, the film is caught between the cutters 50 and the cutting surfaces of the counter knife 30. The corresponding tooth 40 projecting into the groove 72 between the cutter pair 170 over which film is stretched will puncture and tear the film as the cutters 50 pass through the interstices 46.

When the film wraps and/or becomes stretched between the cutter pair 170, the corresponding comb tooth of the counter knife 30 "combs" the groove 72 between the cutter pair 170 and strips the film from its wrapped or stretched position. The action of the cutter pair 170 in reducing the film is similar but not identical to the action of the cutter 50 row in the first embodiment. As the rotor 120 revolves, each cutter pair 170 passes through a corresponding pair of interstices 46, thereby fully cooperating with one tooth and partially cooperating with two teeth 40 of the counter knife 30. Cutting action is reduced from the first embodiment due to the only partial engagement of two of the three teeth 40 engaged. However, the cutter pair 170 configuration randomly dispersed along the rotor 120 body provides a more even feed of material to the screen and further minimizes the likelihood that the film will build up and pack together or clog the screen.

Figure 10:
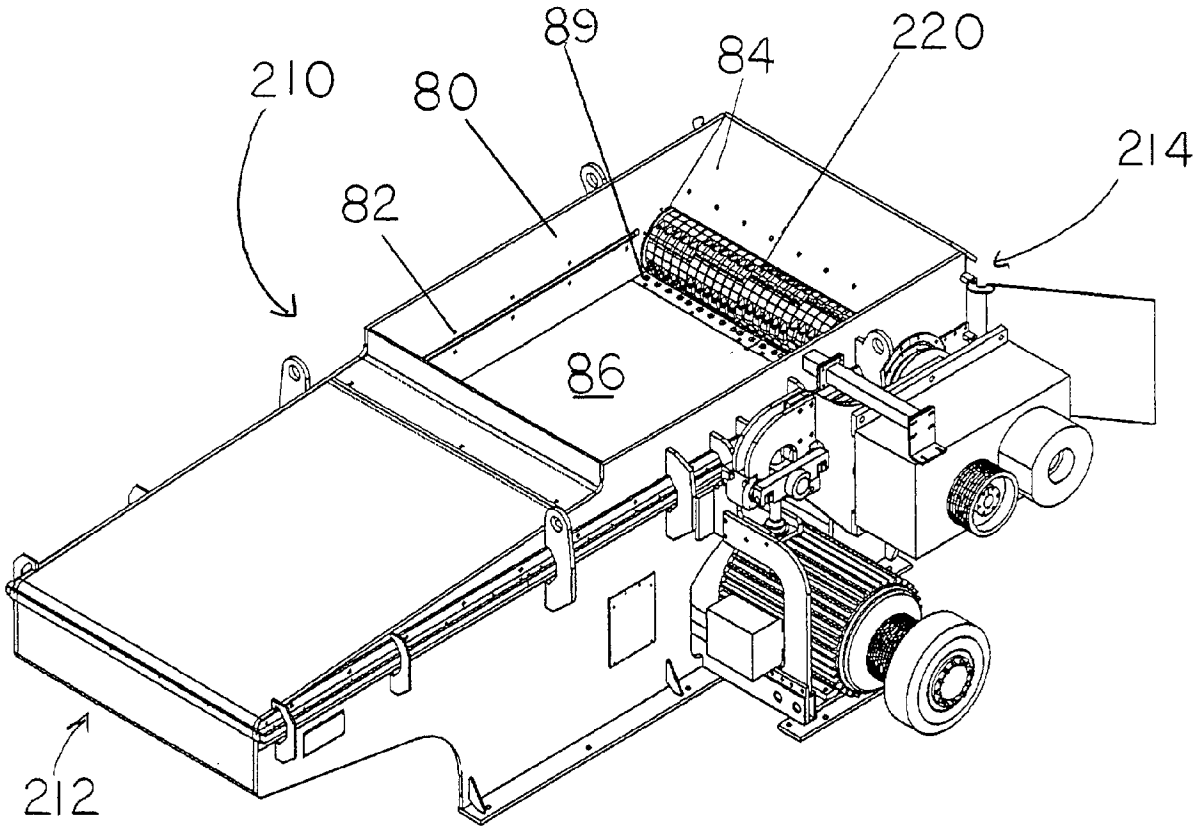
FIG. 10 is a perspective view of an alternate embodiment of the rotary grinder of the present invention, taken from the upper left side, showing the rotor and counter knife combination of the present embodiment.
Figure 16:
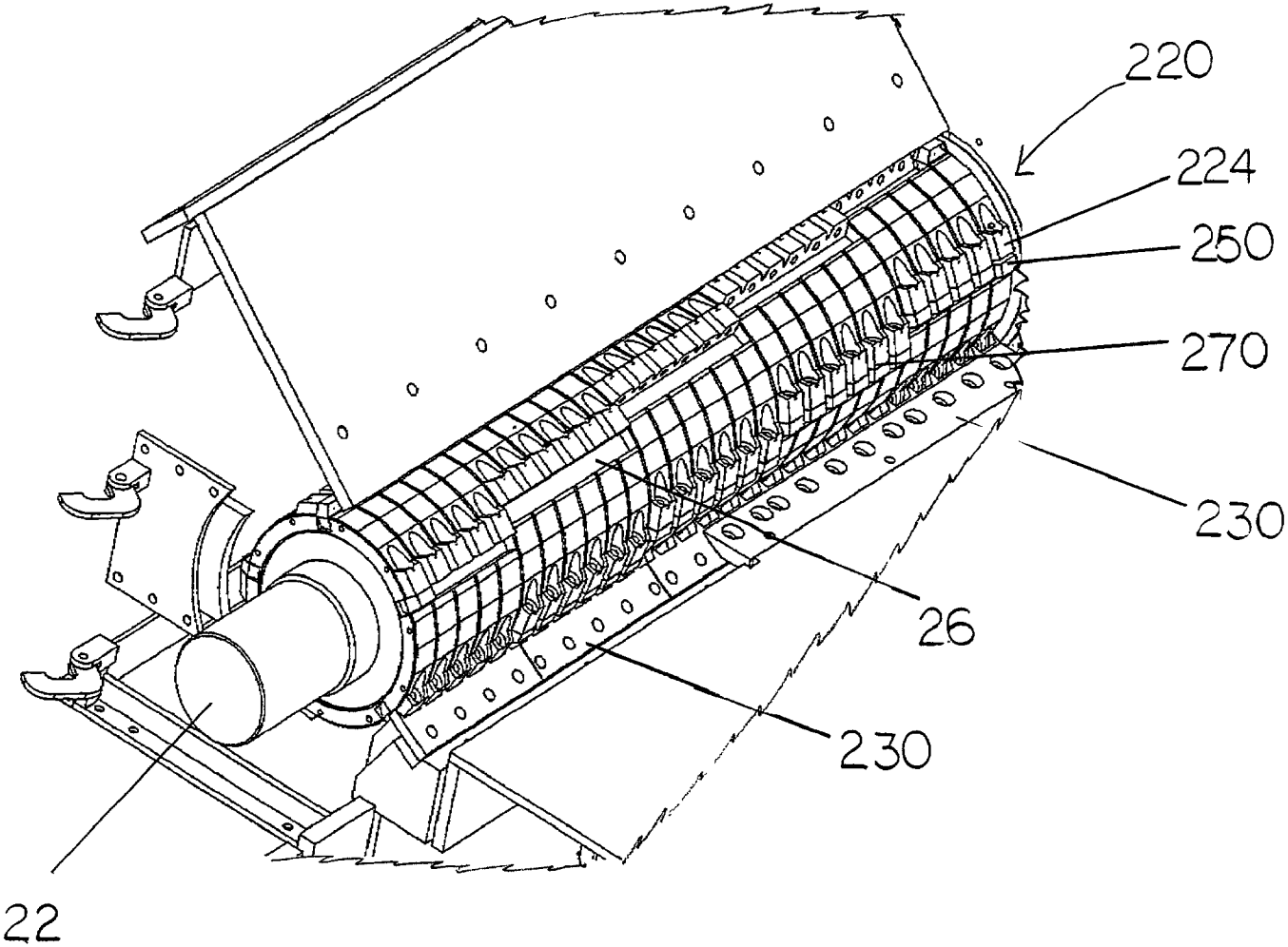
FIG. 16 is a partial perspective view of the rotary grinder of FIG. 10, showing the cutters mounted on the rotor in partial rows and a portion of the cutters passing through the interstices between the teeth of the counter knives.

FIG. 10 shows the preferred embodiment, which is an alternate embodiment of the rotary grinder 210 of the present invention containing an embodiment of the rotor 220 and counter knife 230 combination in the comb configuration of the present invention. The rotary grinder 210 of FIG. 10 has a front end 212; a back end 214; a hopper 80 having a hopper front end 82, a hopper back end 84, a hopper floor 86, and a trough 87 with an angled trough wall 88 in the hopper floor 86 at the hopper back end 84; a ram 92 in a retracted position (not shown); a rotor 220 mounted on a shaft 22 (see also, FIG. 16) at the hopper back end 84; and at least one counter knife 230 (see FIG. 16) mounted on the angled trough wall 88. FIG. 10 (and FIG. 16) also depicts the rotor 220 having tool attachments 224 integral to the rotor 220, a slot 26 in the rotor 220 in front of each tool attachment 224; cutters 250 partially received in slots 26 and mounted to corresponding tool attachments 224 (FIG. 16 depicts only a partial complement of cutters 250 mounted on the rotor); a cushioning plate 268 mounted between each cutter 250 and the corresponding tool attachment 224; and a groove 272 between adjacent tool attachments 224. A counter knife 230 is mounted before the rotor 220 at the hopper back end 84 on the angled trough wall 88 (see FIGS. 11 and 16). A filler plate 89 may be placed over the trough 87 to prevent material to be reduced from accumulating in the trough 87.

Figure 12:
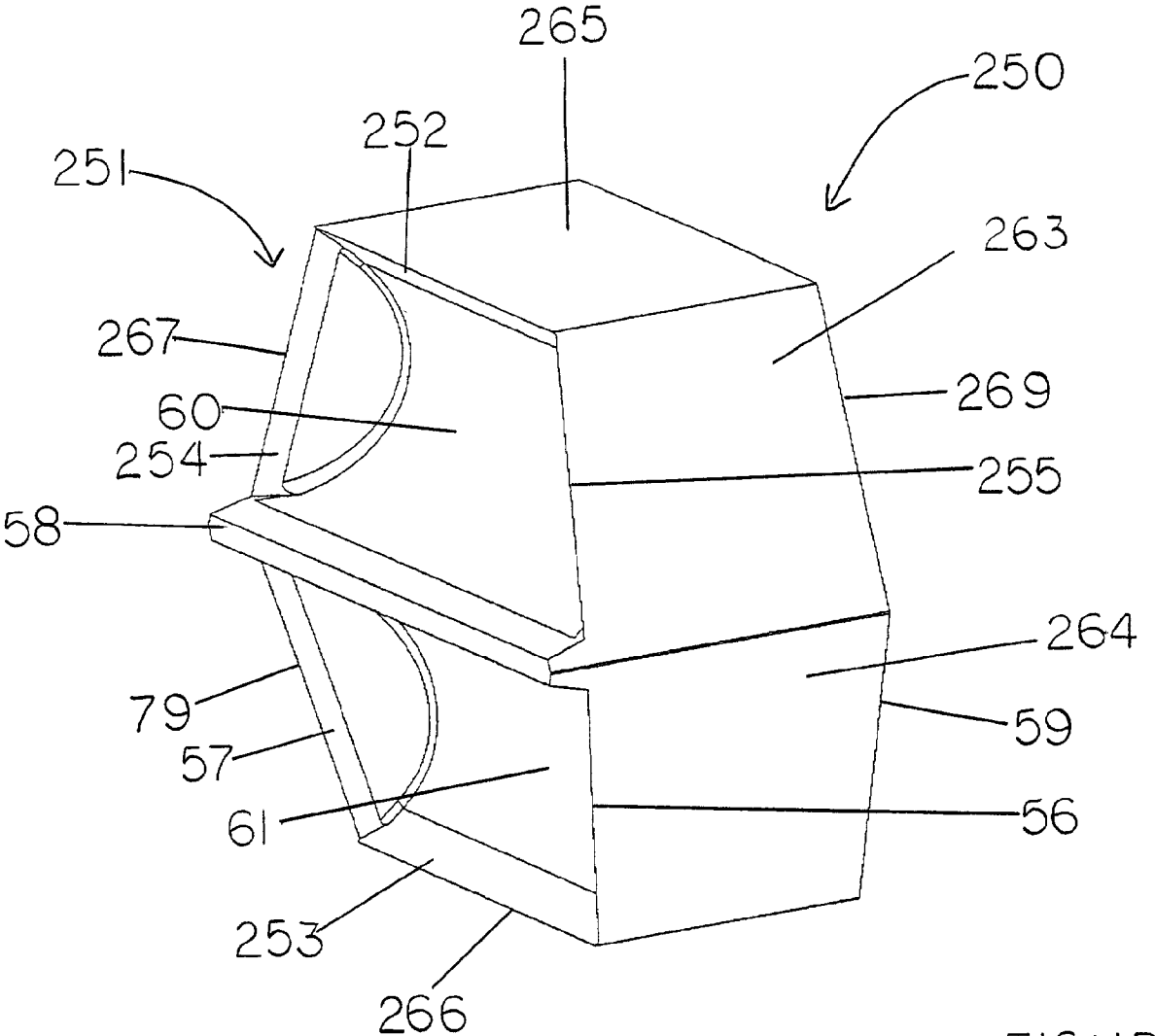
FIG. 12 is a perspective view, taken from the upper front side, of the cutter of FIG. 10.
Figure 13:
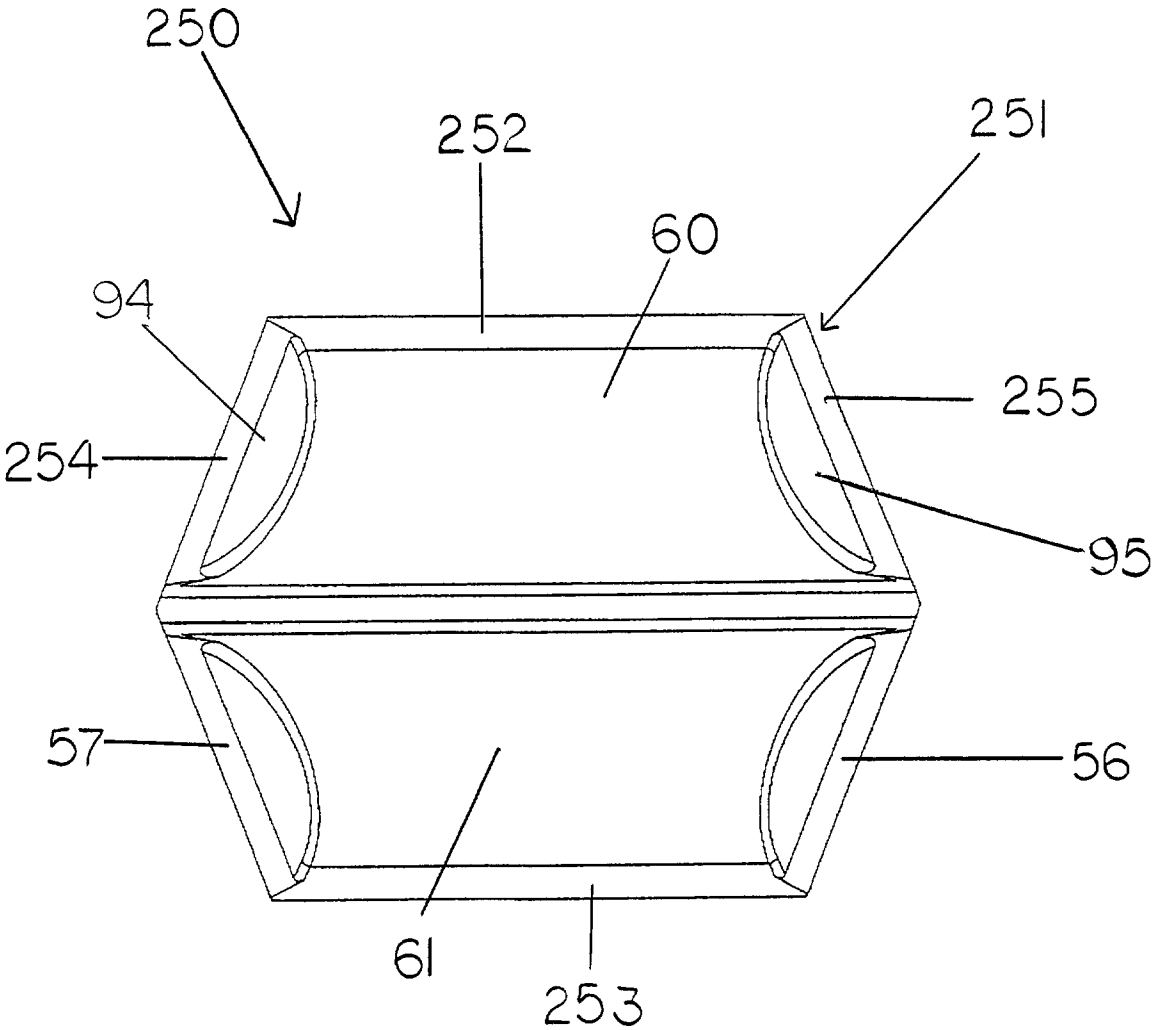
FIG. 13 is a front view of the cutter of FIG. 10.

As shown in FIGS. 12 and 13, the cutter 250 of the preferred embodiment is generally hexagonal in shape and has six sides, namely top side 265, upper left side 269, lower left side 59, bottom side 266, lower right side 79, and upper right side 267, which form a generally hexagonal shape. However, it is contemplated that the number of sides could vary, which would affect the geometric shape of the cutter. The cutter 250 has a front face 251 which has a first concave surface 60 and a second concave surface 61 separated by a protruding edge 58. The first concave surface 60 and second concave surface 61 on the front face 251 are approximately equivalent in size. It is contemplated that the front face 251 could have additional concave surfaces generally equivalent in size and separated by one or more additional protruding edges as needed. Sloping surfaces 94, 95 extends from outer edges 254, 255 towards said generally concave surfaces. The front face is framed by six outer edges, namely, top edge 252, upper left edge 255, lower left edge 56, bottom edge 253, lower right edge 57, and upper right edge 254. However, the number of outer edges could vary as the geometric shape of the cutter 250 varies. The seven edges of the front face 251, namely, top edge 252, upper left edge 255, lower left edge 56, bottom edge 253, lower right edge 57, upper right edge 254, and protruding edge 58, are cutting edges.

The protruding edge 58 is approximately parallel to the top edge 252 and to the bottom edge 253; however, the top edge 252 and the bottom edge 253 are in a first vertical plane, and the protruding edge 58 is in a second vertical plane. The top edge 252, upper left edge 255, protruding edge 58 and upper right edge 254 generally define a trapezoid; and the lower left edge 56, bottom edge 253, lower right edge 57 and protruding edge 58 also generally define a trapezoid.

Figure 14:
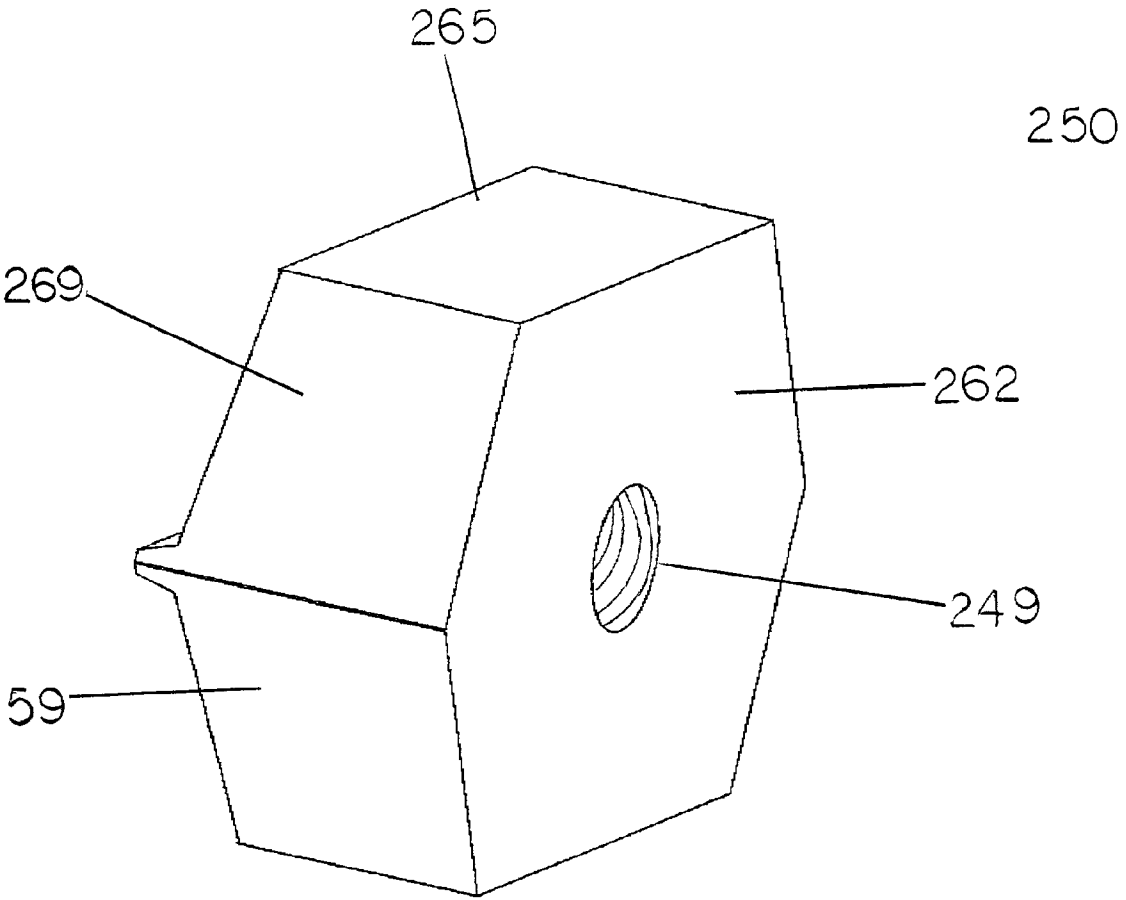
FIG. 14 is a back view of the cutter of FIG. 10.

The cutter 250 has a back face 262 having a generally flat surface (FIG. 14); a top portion 263; and a bottom portion 264 separated on the front face 251 by protruding edge 58. The back face 262 may contain a threaded bore 249 for accepting a screw for mounting onto a tool attachment 224. The top portion 263 and bottom portion 264 of the cutter 250 are generally mirror images, allowing the cutter 250 to be indexable such that, when the cutter is rotated 180 degrees, fresh cutting edges are revealed. While the present invention discloses two index positions, it is contemplated that the cutter 250 be indexable to a plurality of positions. Each cutter 250 is preferably made of hardened tool steel suitable to the application, but may be made of any suitable material.

The hexagonal shape of the cutters 250 of this embodiment increases the cutting surfaces on the cutter and minimizes the amount of non-cutting surfaces on the counter knife 230 and rotor 220 while maintaining the advantages of the combing action of the counter knife 230. The preferably partial row 270 of cutters configuration staggered along the rotor 220 body provides a more even feed of material to the screen and reduces the amount of instantaneous torque required to power the rotor. These features also reduce the tendency of the cutters 250 to self-feed the material and minimizes the heat generated during the cutting process. The cutters 250 may also be arranged in full row 70 arranged longitudinally along the rotor 220 or in pairs 170 in random or staggered arrangement along the rotor 220

Figure 11:
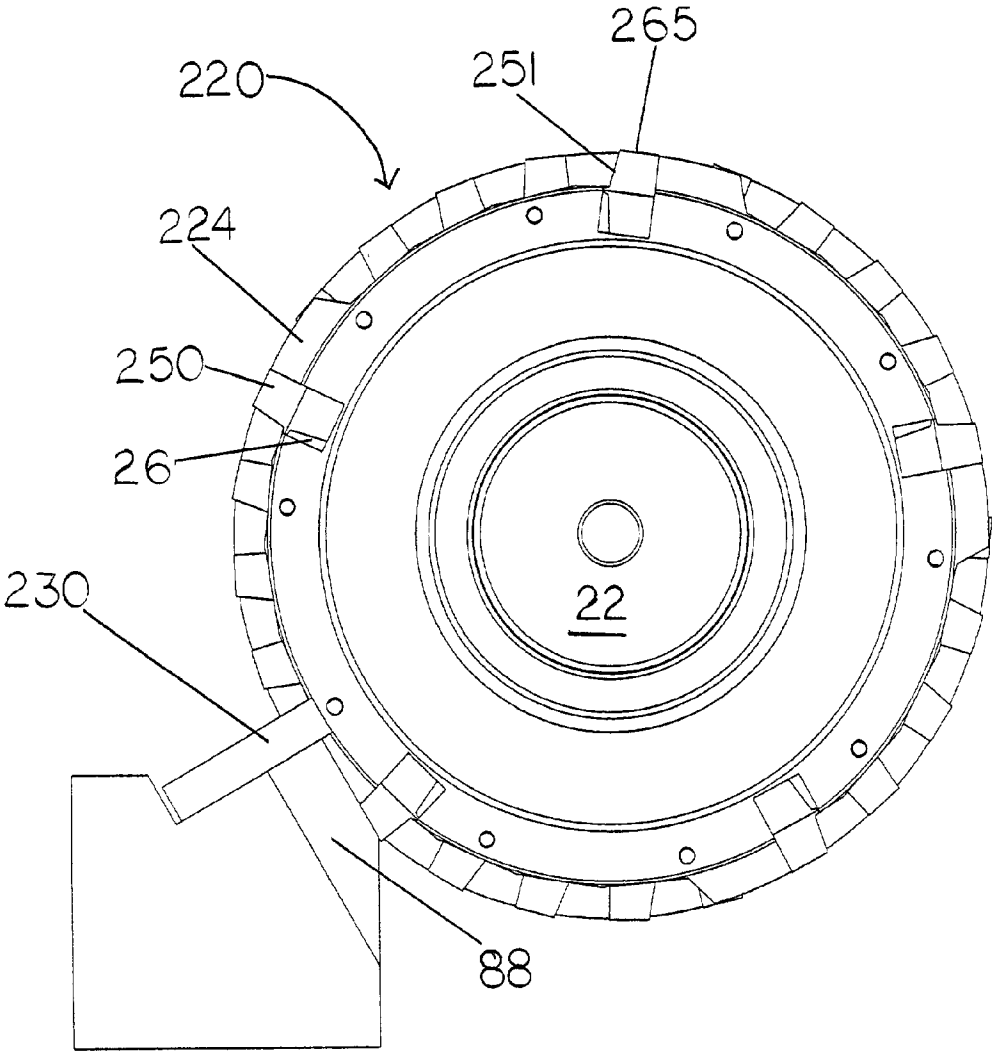
FIG. 11 is a cross-sectional view of the rotor and counter knife combination of FIG. 10 taken along the line 11-11 of FIG. 10.
Figure 17:
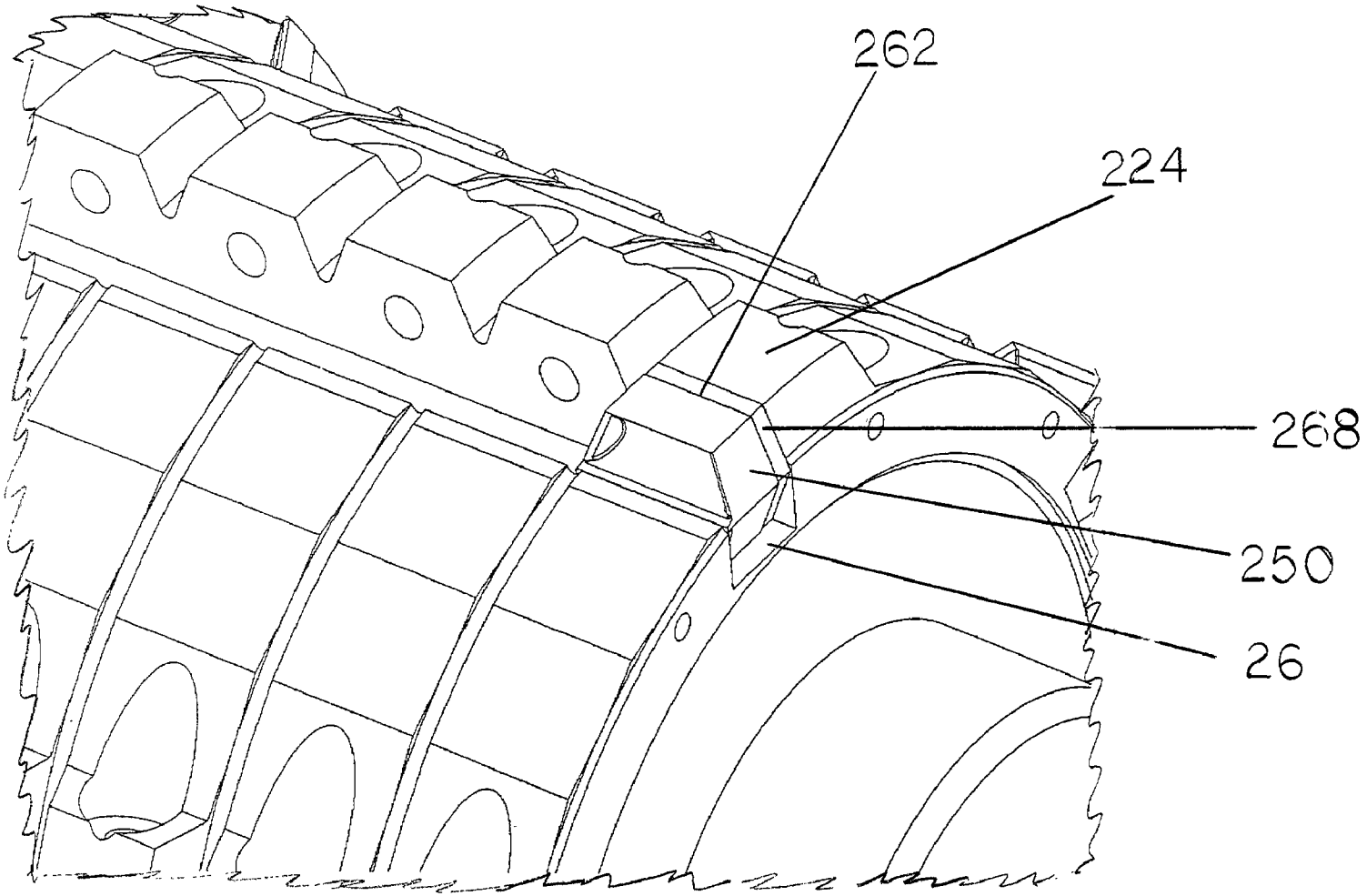
FIG. 17 is an enlarged partial perspective view of the rotor of FIG. 10 showing the tool holders and a cushioning plate and cutter mounted on a tool holder.

As shown in FIGS. 11, 16 and 17, a cutter 250 is removably mounted to each tool attachment 224. The tool attachments 224 are preferably machined into and integral with the rotor 220; however, the tool attachments 224 may instead be welded or otherwise suitably attached or mounted to the rotor 220. The rotor has a plurality of grooves 272 thereon between adjacent tool attachments 224 and which are between adjacent cutters 250 after they are mounted on the tool attachments 224. The slot 26 in the rotor 220 in front of each tool attachment 224 partially receives a cutter 250 when it is removably mounted to that tool attachment 224. For instance, the bottom portion 264 of a cutter 250 can be inserted into a slot 26 with the back face 262 towards the tool attachment 224 and the cutter bottom side 66 resting against the bottom of the slot 26. In this configuration, the top portion 263 of the cutter 250 protrudes out of the slot 26 and functions as the working portion of the cutter 250. When the cutting edges of the cutter top portion 263, namely top edge 252, upper left edge 255, upper right edge 254 and protruding edge 58, are worn, the cutter 250 may be removed, rotated 180 degrees and remounted. In this configuration, the bottom portion 264 of the cutter 250 protrudes out of the slot 26 and functions as the working portion of the cutter 250. When the cutting edges of the cutter bottom portion 264, namely bottom edge 253, lower left edge 56, lower right edge 57 and protruding edge 58, are worn, the cutter 250 would then be removed and retooled or replaced with a new cutter 250.

Figure 18:
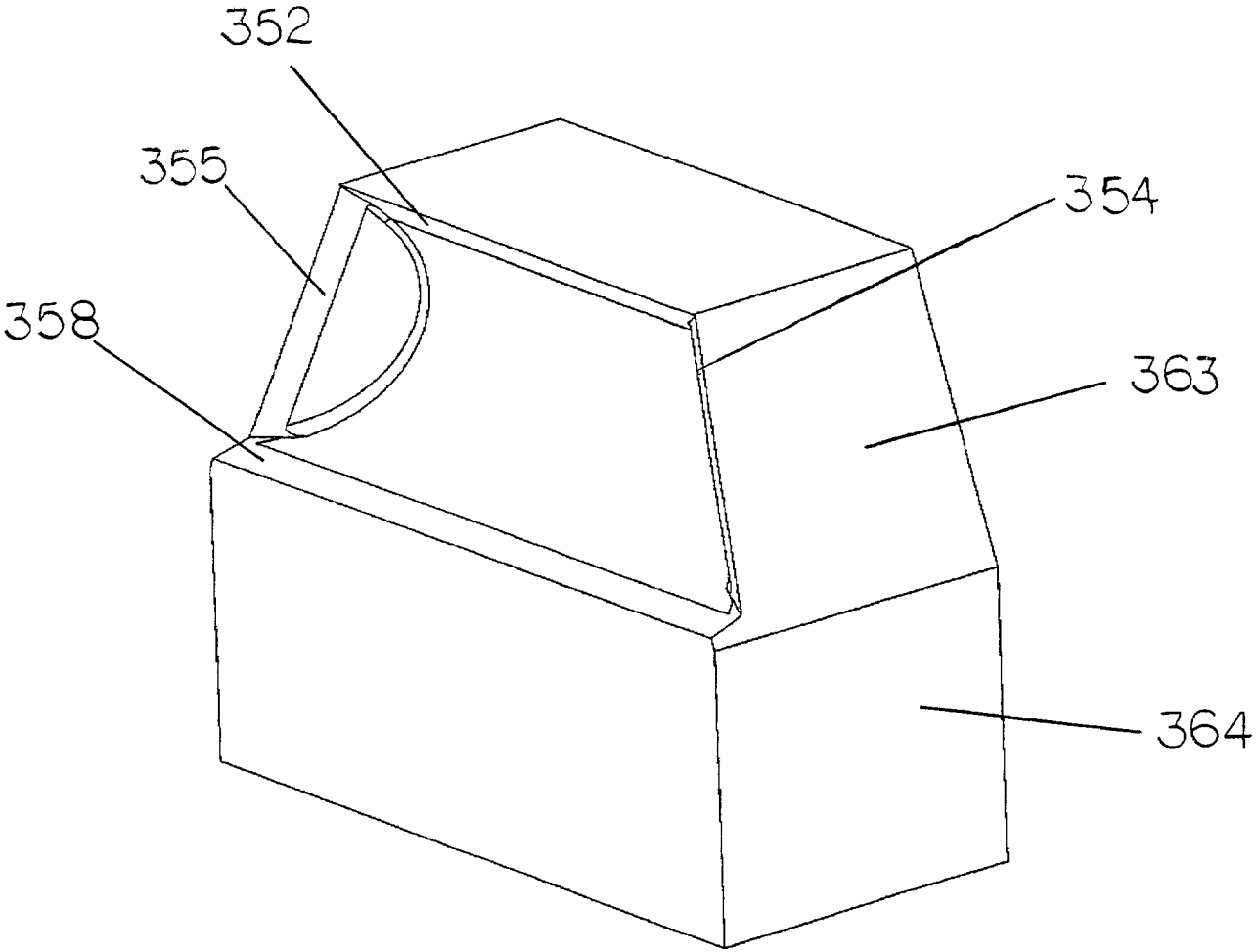
FIG. 18 is a perspective view of an alternative embodiment of a cutter.

FIG. 18 depicts a further embodiment of the cutter 350. The cutter 350 of the present embodiment is generally hexagonal in shape. The cutter 350 has a top portion 363 and a bottom portion 364 separated by protruding edge 358. The top portion is framed by top edge 352, upper left edge 355 and upper right edge 354. However, the number of outer edges could vary as the geometric shape of the cutter 350 varies. The four edges, namely, top edge 352, upper left edge 355, upper right edge 354, and protruding edge 358, are cutting edges. The bottom portion 364 is a plug which may be any shape and size which can be received by slot 26.

As depicted in FIG. 17, an optional cushioning plate 268 may be mounted between the cutter back face 262 and corresponding tool attachment 224 in order to absorb shock and minimize or prevent damage to the tool attachment 224. Each cushioning plate 268 is preferably made of a soft metal or metal alloy, such as soft steel, but may be made of any suitable material.

Figure 15:
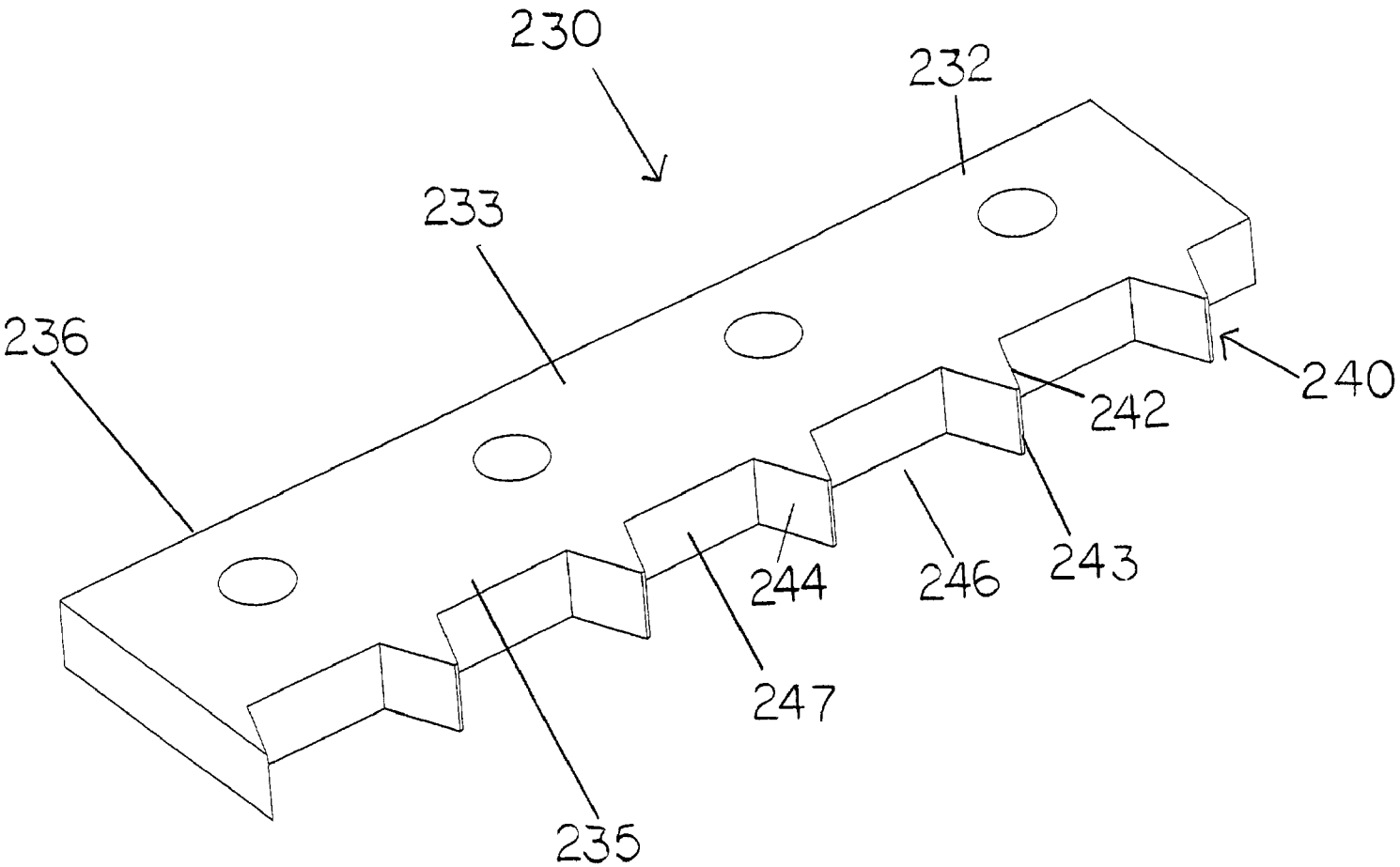
FIG. 15 is a perspective view of the counter-knife of FIG. 10, taken from the upper front side.

As best shown in FIG. 15, the counter knife 230 of the instant embodiment has a generally flat body 232, a top 233, a bottom 234 (not shown), a front 235, a back 236; a plurality of modified "V" shaped teeth 240 extending laterally in the same plane as the body 232 from the front 235 of the body 232. Each tooth 240 forms three sides of a modified V, having a first tooth edge 242, a second tooth edge 243 and a third tooth edge 244. Each pair of adjacent teeth 240 defines an interstice 246 which is open on one side and whose three other sides form a modified "V" which is anchored by an interstice edge 247. A third tooth edge 244 and a first tooth edge 242 extend from the ends of the interstice edge 247 each at an angle of approximately 112.5 degrees. This angle may be varied to accommodate variations in the shape of the cutter 250. The edges 247, 242, 244 which form the interstice 246 are each a cutting edge. When the rotor 220 and counter knife 230 are properly installed in the rotary grinder 210 and the rotor 220 is rotating, the teeth 240 are designed to protrude into the groove 272 between adjacent cutters 250 as each of the adjacent cutters 250 are passing through the corresponding interstices 246 on the counter knife 230. The combination of teeth 240 projecting from the counter knife body 232 with interstices 246 therebetween thereby form a comb configuration.

The third tooth edge 244 is preferably less than 1.016 mm (0.040 inches) in width but may be any suitable width as required by the application and the spacing between the cutters 250. The interstices 246 between the teeth 240 are each preferably 41.173 mm (1.621 inches) in width but may be any suitable width as required by the width of the cutters 250 and the application. The hexagonal shape of the cutters 250 increases the cutting surfaces on the cutter 250, minimizes the amount of non-cutting surfaces 243 on the counter knife 240 and groove 272 while still maintaining the advantages of the combing action of the counter knife 240.

The counter knife 230 is indexable, being symmetrical on its top 233 and bottom 234 sides, such that the counter knife 230 can be turned over to expose fresh cutting edges and remounted with its bottom 234 facing upward when the upper portions of the cutting edges 242, 244, 247 become dull. This allows the cutting edges 242, 244, 247 at the top 233 and bottom 234 sides of the counter knife 230 to be used before the edges 242, 244, 247 are resharpened. Each counter knife 230 is preferably made of hardened tool steel suitable to the application, but may be made of any suitable material.

As shown in FIG. 16, a plurality of counter knives 230 may be installed adjacent each other. The number of counter knives 230 employed, the length of the counter knife 230, the number of full and partial teeth 240 on the counter knife 230, the length and width of the teeth 240 and the width of the interstices 246 are dependent upon the length and size of the rotor 220, the number of cutters 250 employed longitudinally along the rotor 220, the size of the cutters 250 and the positioning of the cutters 250 in relation to adjacent cutters 250.

FIG. 11 clearly shows a counter knife 230 installed on the angled trough wall 88. The counter knife 230 is installed with its bottom 234 portion towards the floor of the trough 87 and with the front 235 portion of its body 232 and teeth 240 extending upward at an angle towards the rotor 220.

As shown in FIG. 16, the tool attachments 224 on the rotor 220 may be arranged longitudinally in a series of partial rows in a staggered arrangement, and the cutters 250 are mounted to the tool attachments 224 so that the cutters 250 form a comb configuration with the partial cutter rows 270.

As best shown in FIGS. 11 and 16, the rotor 220 of the instant embodiment preferably has five sets of partial cutter rows 270 arranged in a staggered arrangement longitudinally along the rotor 220 body. However, the rotor 220 may contain a greater or lesser number of sets of partial cutter rows 270, and correspondingly a greater or lesser number of total cutters 250 on the rotor 220. Cutters 250 immediately adjacent each other in a partial cutter rows 270 are preferably spaced 1.016 mm (0.040 inches) apart, but may be spaced apart any suitable distance as required by the application. Additionally, the number of cutters 250 per set of partial cutter rows 270 will be influenced by the length of the rotor 220. The number of cutters 250 on each rotor 220 will influence the amount of horsepower required to power the rotor 220. An increase in the number of cutters 250 present on the rotor 220 will increase the amount of horsepower required, and a decrease in the number of cutters 250 will decrease the amount of horsepower required. The partial row of cutters configuration staggered along the rotor body provides a more even feed of material to the screen and reduces the amount of horsepower required to power the rotor.

As shown in FIG. 16, when the rotor 220 revolves on its shaft 22, each cutter 250 passes at a small distance from the counter knife 230 through a corresponding interstice 246 located in the same vertical plane as the cutter 250. At its smallest width, the groove 272 between the two adjacent cutters 250 is preferably 1.016 mm (0.040 inches). Additionally, each tooth 240 located between two adjacent interstices 246 protrudes into the groove 272 between the two adjacent cutters 250 located in the same vertical plane as each of the two adjacent cutters 250 is passing through the corresponding one of the two adjacent interstices 246, the tooth 240 protruding to within a small distance from the rotor 220, which effectively "combs" the rotor 220.

As a cutter 250 passes through an interstice 246, it is preferred that there is a first spacing 74 of 0.254 mm (0.010 inches), with an additional manufacturing tolerance of 0.127 mm (0.005 inches), between the third tooth edge 244 and the right edge 54 and between the first tooth edge 242 and the left edge 55; and a second spacing 76 of 0.127 mm (0.005 inches), with an additional manufacturing tolerance of 0.050 mm (0.002 inches), between the of cutter top edge 252 and the interstice edge 247, although the first spacing 74 and second spacing 76 may be larger or smaller if required by the application. However, due to the temperature variation caused by the heat produced as the rotor 220 rotates and the resulting expansion of the rotor 220 in length, it would not be practical to reduce the first spacing 74 or second spacing 76 without employing a means to cool the rotor 220. The first spacing 74 and second spacing 76 are also present when the cutter 250 is indexed 180 degrees to its second index position.

When the ram 92 pushes the film to be reduced into the revolving rotor 220, each cutter 250 in a set of partial cutter rows 270 engages a portion of the film. The cutting edges 252, 255, 56, 253, 57, 254, 58 and concave surface 60, 61 of the working portion of the cutter 250 cooperate to cut and scoop out portion of the film. As the cutters 250 move downward towards the counter knives 230, the cutting edges 252, 255, 56, 253, 57, 254, 58 on the working portion of the cutter cut through the film while the concave surface 60, 61 on the working portion of the cutter and the downward action of the cutter 250 act to scoop out a generally trapezoidally shaped portion of film and transport it towards the counter knives 230. After a cutter 250 passes through the counter knife 230 the scooped portion of plastic is expelled from the cutter 250 as it reaches toward the bottom arc of its rotation. The cutters 250 also engage and drag uncut portions of film towards the counter knives 230. As the partial cutter row 270 passes through the interstices 246, any film caught outside the concave surfaces 60, 61 of the cutter 250 is either cut between the cutter 250 and the cutting edges 242, 244, 247 of the counter knife 230 or punctured and torn by the corresponding tooth 240 projecting into the groove 272 between two adjacent cutters 250 over which film is stretched as the cutters 250 pass through the interstices 246. When the film wraps and/or becomes stretched between cutters 250, the teeth 240 of the counter knife 230 "comb" the groove 272 between the cutters 250 and strip the film from its wrapped or stretched position. Additionally, when there is a sufficiently close spacing between each cutter 250 and the counter knife 230 (see FIG. 16) and/or layers of film have built up sufficiently on the cutters 250 to fill the gap between the cutter 250 and the counter knife 230, further cutting action is provided by the scissor action between the sides 267, 269, 79, 59 and cutting edges 255, 254, 56, 57 of the cutter 250 and the corresponding cutting edges 242, 244 of adjacent teeth 240.

In addition to reduction of film, the scooping action of the cutting edges 252, 255, 56, 253, 57, 254, 58 and the concave surfaces 60, 61 of the cutter 250 have proven useful in reducing solid plastics and reducing rubber into smaller particles. Furthermore, the scooping action of the cutters 250 controls the maximum size of the reduced material, which eliminates or reduces the need for a screen placed after the rotor 220. Smaller sized cutter 250 will result in an even smaller particle size.

The foregoing detailed description is given primarily for clearness of understanding and no unnecessary limitations are to be understood therefrom for modifications will become obvious to those skilled in the art upon reading this disclosure and may be made without departing from the spirit of the invention.

What is claimed is:

1. A rotor and counter knife for a rotary grinder combination, comprising: a rotor having a longitudinal axis and a plurality of sets of tool holders machined from and extending radially from a circumferential surface of said rotor, said plurality of sets of tool holders formed integrally with said rotor, each of said plurality of sets of tool holders having at least two axially aligned tool holders extending parallel to said longitudinal axis along said circumferential surface of said rotor, wherein a first set of said plurality of sets of tool holders has a first angular length and wherein an adjacent second set of said plurality of sets of tool holders has the same said first angular length and further wherein said second set is offset from said first set by a second angular length which is less than or equal to said first angular length, each of said tool holders having a cutter thereon, each of said cutters having a cutting edge extending from said rotor, said counter knife having a continuous knife cutting edge which becomes substantially adjacent at least one cutting edge of a cutter within a rotation of said rotor, wherein at least said cutters of one of said sets of plurality of said tool holders are overlapping an adjacent one of said sets of said plurality of said tool holders along a direction parallel to said longitudinal axis.

2. The rotor and counter knife of claim 1 wherein said plurality of sets of said tool holders are randomly spaced about said circumferential surface of said rotor.

3. The rotor and counter knife of claim 1 wherein said plurality of said sets of said tool holders are spaced about said circumferential surface of said rotor forming at least one row of said tool holders extending along the full axial length of said rotor, said at least one row of said tool holders being coextensive or overlapping along said circumferential surface of said rotor.

4. The rotor and counter knife of claim 1 wherein said rotor has a slot therein in front of each of said tool holders for receiving a portion of each of said cutters.

5. The rotor and counter knife of claim 1 wherein said counter knife has a plurality of points with an interstice between each of said points forming said continuous knife cutting edge, each of said interstices substantially receiving at least one cutter within a rotation of said rotor, said cutting edge of each of said plurality of cutters being closely received by an interstice.

6. The rotor and counter knife of claim 1 wherein each of said cutters are trapezoidal.

7. The rotor and counter knife of claim 1 wherein each of said cutters has a concave face surrounded by said cutting edge.

8. The rotor and counter knife of claim 1 wherein said plurality of said sets of said tool holders are spaced about said circumferential surface of said rotor forming at least one row of said tool holders extending along the full axial length of said rotor, said at least one row of said tool holders being aligned with a longitudinal axis of said rotor.

* * * * *